US006745544B2

(12) United States Patent
Matsumoto et al.

(10) Patent No.: US 6,745,544 B2
(45) Date of Patent: Jun. 8, 2004

(54) METHOD OF AND APPARATUS FOR WRAPPING LOADABLE OBJECTS

(75) Inventors: Ryozo Matsumoto, Fukuoka (JP); Okinori Anai, Fukuoka (JP)

(73) Assignee: Matsumoto System Engineering Co., Ltd., Fukuoka (JP)

( * ) Notice: Subject to any disclaimer, the term of this patent is extended or adjusted under 35 U.S.C. 154(b) by 0 days.

(21) Appl. No.: 09/824,209

(22) Filed: Apr. 3, 2001

(65) Prior Publication Data

US 2002/0020145 A1 Feb. 21, 2002

(30) Foreign Application Priority Data

Apr. 4, 2000 (JP) ..... P2000-102073
Aug. 18, 2000 (JP) ..... P2000-248530

(51) Int. Cl.[7] ..... B65B 13/02; B65B 11/58; B65B 4/16

(52) U.S. Cl. ..... 53/399; 53/441; 53/449; 53/176

(58) Field of Search ..... 53/399, 441, 449, 53/176, 87, 88, 588

(56) References Cited

U.S. PATENT DOCUMENTS

| | | | | | |
|---|---|---|---|---|---|
| 2,026,282 | A | * | 12/1935 | Leguillon | 206/323 |
| 2,489,054 | A | * | 11/1949 | Sprollle | 206/386 |
| 3,695,426 | A | * | 10/1972 | Engelsberger | 206/497 |
| 3,853,218 | A | * | 12/1974 | Grasvoll | 206/595 |
| 3,896,604 | A | * | 7/1975 | Marantz | 53/176 |
| 4,429,794 | A | * | 2/1984 | Steger et al. | 206/597 |
| 4,655,028 | A | * | 4/1987 | Silbernagel | 53/133.6 |
| 4,676,048 | A | * | 6/1987 | Lancaster et al. | 53/210 |
| 4,712,354 | A | * | 12/1987 | Lancaster et al. | 53/176 |
| 4,726,172 | A | * | 2/1988 | Widenback | 53/176 |
| 4,807,427 | A | * | 2/1989 | Casteel et al. | 53/556 |
| 4,821,489 | A | * | 4/1989 | MacLeod et al. | 53/137.2 |
| 5,079,898 | A | * | 1/1992 | Springs et al. | 53/399 |
| 5,182,894 | A | * | 2/1993 | Bate | 53/170 |
| 5,184,449 | A | * | 2/1993 | Hannen | 53/176 |
| 5,195,297 | A | * | 3/1993 | Lancaster et al. | 53/176 |
| 5,224,911 | A | * | 7/1993 | Wong | 220/4.28 |
| 5,404,691 | A | * | 4/1995 | Scherer | 53/339 |
| 5,463,843 | A | * | 11/1995 | Sharp | 53/399 |
| 5,531,061 | A | | 7/1996 | Peterson | |
| 5,660,023 | A | * | 8/1997 | Kivela | 53/176 |
| 5,689,934 | A | * | 11/1997 | Scherer et al. | 53/176 |
| 5,720,153 | A | * | 2/1998 | Martin-Cocher | 206/598 |
| 5,799,466 | A | * | 9/1998 | Underhill | 53/176 |

FOREIGN PATENT DOCUMENTS

| | | | |
|---|---|---|---|
| DE | 90 12 589 | | 11/1999 |
| EP | 0 553 681 | | 1/1993 |
| GB | 2269795 | * | 2/1994 |
| JP | 59-46845 | | 11/1984 |
| JP | 8-508223 | | 9/1996 |
| WO | 92/14648 | | 9/1992 |

* cited by examiner

*Primary Examiner*—Rinaldi I. Rada
*Assistant Examiner*—Paul Durand
(74) *Attorney, Agent, or Firm*—Wenderoth, Lind & Ponack, L.L.P.

(57) ABSTRACT

A simple operation winds film around, and thereby wraps therewith, a loadable object over its entire (six) surfaces. Film is wound spirally around the loadable object by revolving film feeders along a circular path about a horizontal axis while advancing the object through the circular path and along a path of the horizontal axis in one direction. After the loadable object is so spirally wrapped, it is rotated in a horizontal or vertical plane by an angle of 90 degrees. The loadable object is then advanced in the reverse direction again through the circular path while the film feeders are revolved as before to cause another film from the film feeders to be wound spirally around the loadable object. One film feeder may furnish a continuous strip of film, and another film feeder may furnish a continuous string of film formed by compression of such a strip of film.

22 Claims, 29 Drawing Sheets

METHOD OF AND APPARATUS FOR WRAPPING LOADABLE OBJECTS

BACKGROUND OF THE INVENTION

1. Field of the Invention

The present invention relates to a method of and apparatus for wrapping loadable objects in which a loadable object brought in as a mass is wrapped by spirally winding film around the object, both about a horizontal axis and about a vertical axis thereof.

2. Description of the Prior Art

Wrapping methods and apparatus of the type described above have been known in the art as shown and described in JP 59-46845 B and JP 8-508223 A.

JP 59-46845 B, referred to as the first prior art below, discloses an arrangement in which a loadable object is placed on a conveyor whose upper and lower surfaces move in an identical direction at an identical speed. A web made of stretchable material is wound around both the conveyor and the loadable object being carried by the conveyor. The loadable object is allowed to move beyond a downstream end of the conveyor to come off the conveyor where shrinkage of the web causes the loadable object alone to be wrapped thereby.

JP 8-508223 A, referred to as the second prior art below, describes in one of its intended forms of implementation an arrangement in which a web is wound around a loadable object, on a first table, about a horizontal axis and is thereby wrapped. The object so wrapped is then moved onto a second table, which is rotated about a vertical axis of the second table to further wrap a web around the object in a direction perpendicular to the direction in which the object is wrapped on the first table.

The second prior art also describes in another form of implementation contemplated, the use of a wrapping device that is revolvable about a vertical axis in an arrangement in which a loadable object is rotatable about a horizontal axis. Thus, a web may be wrapped around the loadable object about a vertical axis by revolving the wrapping device about the vertical axis, and about a horizontal axis by rotating the loadable object about the horizontal axis.

The capability by the first prior art of wrapping a web only about a horizontal axis is inconveniently unsuitable to wrap, and thereby to package, three-dimensional objects.

Also, while the second prior art permits a web to be wrapped around a loadable object about both horizontal and vertical axes thereof, if its one form of implementation is adopted in which the object is wrapped in dissimilar directions, it is required that the object be placed from the first to the second table, that a web roll be tilted 90 degrees while a web is being wrapped around the object, and moreover that the second table be rotated. Therefore, not only is a cumbersome double wrapping operation entailed, but also an apparatus for practicing this operation becomes inconveniently complex in terms of mechanisms.

In the other form of implementation of the second prior art, a technique that is capable of doubly wrapping web material around a loadable object resting at the same position, about both vertical and horizontal axes, a need to include two independent mechanisms for wrapping web material about the horizontal and vertical axes, respectively, makes equipment again inconveniently complex and large-scaled.

Further as described in the second prior art, the technique of wrapping film in the form of a continuous strip doubly around a loadable object about both axes is efficient to thoroughly cover an entire surface of the object therewith, but such wrappage is weak in strength and gives rise to a problem in that if the wrappage is hit by something sharp it may easily rupture to allow its contents to escape.

BRIEF DESCRIPTION OF THE INVENTION

With the foregoing state of art taken into account, it is an object of the present invention to provide a method of wrapping a loadable object using a conventional wrapping machine for wrapping film around loadable objects about a horizontal axis, which method permits film to be easily wrapped around the loadable object both about its horizontal and about its vertical axes. An additional object of the present invention is a wrapping apparatus for use in carrying out the method.

Another object of the present invention is to provide a wrapping technique whereby a continuous strip of film, and a continuous string of film formed by compressing such a continuous strip of film, are both spirally wound around a loadable object about both a horizontal and a vertical axis thereof, which technique makes wrapping much less rupturable and prevents run-out of dust or refuse from the loadable object.

In order to achieve the objects mentioned above, the present invention provides in one method aspect thereof a method of wrapping a loadable object, which method comprises: revolving a film feeder about a horizontal axis along a circular path while advancing a loadable object through the circular path and along a path extending in a direction of the horizontal axis from a first side towards a second side to cause film from the film feeder to be wound spirally around the loadable object, thereby wrapping at least a portion or a major part of the loadable object; thereafter rotating the loadable object in a horizontal plane by an angle of 90 degrees; and advancing the loadable object along the horizontal path from the second side towards the first side while revolving the film feeder about the horizontal axis along the circular path to cause film from the film feeder to be again wound spirally around the loadable object, thereby completing wrapping the loadable object.

The present invention also provides a method of wrapping a loadable object, which method comprises: revolving a film feeder about a horizontal axis along a circular path while advancing a loadable object through the circular path and along a path extending in a direction of the horizontal axis from a first side towards a second side to cause film from the film feeder to be wound spirally around the loadable object, thereby wrapping at least a portion or a major part of the loadable object; thereafter rotating the loadable object in a vertical plane by a phase angle of 90 degrees; and advancing the loadable object along the horizontal path from the second side towards the first side while revolving the film feeder about the horizontal axis along the circular path to cause film from the film feeder to be wound spirally again around the loadable object, thereby completing wrapping of the loadable object.

The present invention also provides a method of wrapping a loadable object, which method comprises: providing a film feeder for supplying a plurality of films, at least one of which is a continuous strip of film and at least another of which is a continuous string of film formed by compressing such a continuous strip of film; and revolving the film feeder about a horizontal axis along a circular path while advancing a loadable object through the circular path and along a path extending in a direction of the horizontal axis to cause at least one continuous strip of film and at least one continuous string of film from the film feeder to be wound spirally around the loadable object, thereby wrapping the loadable object with such at least one continuous strip and at least one continuous string of film.

In a specific form of an embodiment of the present invention, the loadable object is placed on a sleeve pallet that is adapted to accept a fork of a forklift, and film from the feeder is wound around both the loadable object and the sleeve pallet.

According to one apparatus aspect for carrying out one method described above, the present invention provides an apparatus for wrapping a loadable object, which apparatus comprises: a film feeder adapted for revolving about a horizontal axis along a circular path; and a bi-directional conveyor adapted to carry and advance a loadable object through the circular path in a direction of the horizontal axis from a first side towards a second side and from the second side towards the first side, whereby the film feeder so revolving in conjunction with the loadable object so advanced by the conveyor from the first side towards the second side causes film from the film feeder to be wound spirally around the loadable object, thereby wrapping at least a portion or a major part of the loadable object. The apparatus further comprises: a carrier table juxtaposed with the conveyor at the second side for receiving the loadable object having a continuous strip of film wound around it, rotating the received loadable object in a horizontal plane by an angle of 90 degrees, and then returning the rotated loadable object onto the conveyor, whereby the film feeder revolving as aforesaid in conjunction with the loadable object from the carrier table advanced by the conveyor as aforesaid from the second side towards the first side causes film from the film feeder to be again wound spirally around the loadable object, thereby completing wrapping of the loadable object.

The present invention also provides an apparatus for wrapping a loadable object, which apparatus comprises: a film feeder adapted for revolving about a horizontal axis along a circular path; and a bi-directional conveyor adapted to carry and advance the loadable object through the circular path in a direction of the horizontal axis from a first side towards a second side and from the second side towards the first side, whereby the film feeder so revolving in conjunction with the loadable object so advanced by the conveyor from the first side towards the second side causes film from the film feeder to be wound spirally around the loadable object, thereby wrapping at least a portion or a major part of the loadable object. The apparatus further comprises a carrier table juxtaposed with the conveyor at the second side for receiving the loadable object having a continuous strip of film wound around it, rotating the received loadable object in a vertical plane by an angle of 90 degrees, and then returning the rotated loadable object onto the conveyor, whereby the film feeder revolving as aforesaid in conjunction with the loadable object from the carrier table advanced by the conveyor as aforesaid from the second side towards the first side causes film from the film feeder to be again wound spirally around the loadable object, thereby completing wrapping of the loadable object.

The present invention also provides an apparatus for wrapping a loadable object, which apparatus comprises: a film feeder adapted for revolving about a horizontal axis along a circular path; and a conveyor adapted to carry and advance the loadable object through the circular path in a direction of the horizontal axis, whereby the film feeder so revolving in conjunction with the loadable object so advanced by the conveyor causes film from the film feeder to be wound spirally around the loadable object, thereby wrapping the loadable object. The film feeder comprises a plurality of film feeders, at least one of which includes in a film feed outlet thereof a squeeze roller device for squeezing a continuous strip of film being fed out so as to narrow its width and thereby to provide a continuous string of film, whereby the loadable object is wound spirally and thereby wrapped with such continuous strip and continuous string of film.

The constructions mentioned above allow a loadable object to move forth and back through a conventional wrapping machine, and during such bi-directional movement of the loadable object, film is wound around the loadable object over its entire orthogonal six surfaces and doubly on both its upper and lower or front and back surfaces with strips of intersecting fim.

Also, forming film from a continuous strip into a continuous string in at least one film feeder allows a loadable object to be wound and thereby tightly wrapped with a wider form of film and a compressed form of film.

Further, using a sleeve pallet allows a fork of a forklift, in carrying a film wrapped loadable object together with the sleeve pallet, to be accepted by the sleeve pallet upon breaking the film.

In order to achieve the objects mentioned above, the present invention provides in another aspect thereof a method of wrapping a loadable object, which method comprises: supplying a film wrapping machine with a loadable object by extruding the loadable object from a loadable object feeder through a press nozzle into an area defined between a pair of guide plates within a circular path in the film wrapping machine; and revolving a film feeder about a horizontal axis along the circular path while advancing the supplied loadable object through the circular path and along a path extending in a direction of the horizontal axis to cause film from the film feeder to be spirally wound around the loadable object with a portion of the press nozzle and the guide plates inclusive.

The present invention also provides a method of wrapping a loadable object, which method comprises: revolving a film feeder about a horizontal axis along a circular path while advancing a loadable object through the circular path and along a path extending in a direction of the horizontal axis to cause film from the film feeder to be spirally wound around the loadable object about the horizontal axis; ceasing the film feeder from being revolved; and advancing the loadable object in a direction of a vertical axis while rotating the loadable object about the vertical axis to cause film to be wound spirally around the loadable object about the vertical axis. The film feeder comprises a plurality of film feeders positioned along the circular path, at least one of which is adapted to supply film in the form of a continuous strip, and at least another of which is adapted to form such a continuous strip of film into a continuous string of film and supply the latter, whereby the loadable object is wound and thereby wrapped with such at least one continuous strip and continuous string of film.

In another apparatus aspect for carrying out a method as described above, the present invention also provides an apparatus for wrapping a loadable object, which apparatus comprises: a film wrapping machine having an inlet for receiving a loadable object from a loadable object feeder, with the inlet having a press nozzle formed into a shape adapted to surround the loadable object from the loadable object feeder; a film feeder adapted for revolving about a horizontal axis along a circular path defined in the film wrapping machine; and a conveyor adapted to carry and advance the loadable object through the circular path in a direction of the horizontal axis, whereby the film feeder so revolving in conjunction with the loadable object so advanced by the conveyor causes film from the film feeder to be wound spirally around the loadable object, thereby wrapping the loadable object.

The present invention also provides an apparatus for wrapping a loadable object, which apparatus comprises: a film wrapping machine; a film feeder adapted for revolving about a horizontal axis along a circular path defined in the film wrapping machine; a conveyor adapted to carry and advance a loadable object from a loadable object feeder through the circular path in a direction of the horizontal axis from a first side to a second side, whereby the film feeder so revolving in conjunction with the loadable object so advanced by the conveyor from the first side towards the second side causes film from the film feeder to be wound spirally around the loadable object about the horizontal axis, whereon the film feeder ceases to be revolved; and a rotary table disposed adjacent to the second side for advancing the loadable object in a direction of a vertical axis while rotating the loadable object about the vertical axis to cause film to be wound spirally around the loadable object about the vertical axis. The film feeder comprises a plurality of film feeders, at least one of which is positioned for film to be paid out therefrom oriented parallel to the horizontal axis, and at least another of which is positioned for film to be paid out therefrom oriented parallel to the vertical axis.

According to a specific arrangement of the present invention, the film feeder includes: a film support shaft for carrying a roll of film; an inlet and an outlet roll adapted to be driven to guide and pay out film from the roll of film carried by the film support shaft; and a coupling mechanism interposed between the inlet and outlet rolls for establishing a relationship between these rolls such that the inlet roll rotates slower than the outlet roll rotates. The coupling mechanism is coupled to a shaft for the inlet roll and coupled via a centrifugal clutch to a shaft for the outlet roll.

According to another specific arrangement of the present invention, the above-mentioned rotary table has a conveyor mounted thereon and is adapted to move in a direction in which the conveyor conveys.

According to another specific arrangement of the present invention, the wrapping machine is movable towards and away from the loadable object feeder.

In the construction described above, while a loadable object is advancing horizontally, revolving the film feeders causes film paid out from one film feeder, so oriented that film is paid out parallel to the horizontal axis, to be wound in the form of a continuous strip spirally around the loadable object with a portion of the press nozzle and the guide plates inclusive, and causes film paid out from another film feeder, so oriented that film is paid out parallel to the vertical axis, to be wound in the form of a continuous string spirally around the loadable object with a portion of the press nozzle and the guide plates inclusive.

Also, in a state in which a film feeder ceases to revolve, if a loadable object on the rotary table is lifted and rotated about a vertical axis, a resultant change in the axis about which film is wound around the loadable object relative to vertical causes film paid out from that film feeder, which is so oriented that film is paid out parallel to the horizontal axis, to be wound in the form of a continuous string spirally around the loadable object, and causes film paid out from that film feeder, which is so oriented that film is paid out parallel to the vertical axis, to be wound in the form of a continuous strip spirally around the loadable object.

Consequently, moving the loadable object horizontally causes film to be wound spirally around the loadable object about the horizontal axis, and lifting and rotating the rotary table causes film to be wound spirally around the loadable object about the vertical axis.

Also, in each film feeder, if a rate of paying out film is low, slow rotation of the outlet roll leaves the centrifugal clutch deactuated and thus leaves both rolls rotating at a same peripheral speed. A rise in the rate of paying out film actuates the centrifugal clutch to couple the outlet roll and the coupling mechanism on the latter's side via the centrifugal clutch. This causes the inlet roll to rotate slower than the outlet roll, and a difference in peripheral speed between the two rolls causes film to elongate or stretch where it is running between the rolls.

Also, the conveyor on the rotary table is made movable towards an arriving loadable object. Thus, by moving the conveyor to an upstream side of its direction of conveyance, placement of the loadable object onto the rotary table is facilitated.

Further, guiding through a press nozzle a loadable object supplied from a loadable object feeder into the wrapping machine prevents the loadable object from falling. Further, moving the wrapping machine away from the loadable object feeder creates a space therebetween where maintenance operations can readily be conducted. This also facilitates cleaning an environment of the wrapping machine.

DETAILED DESCRIPTION OF THE PREFERRED EMBODIMENTS

Figure 1:
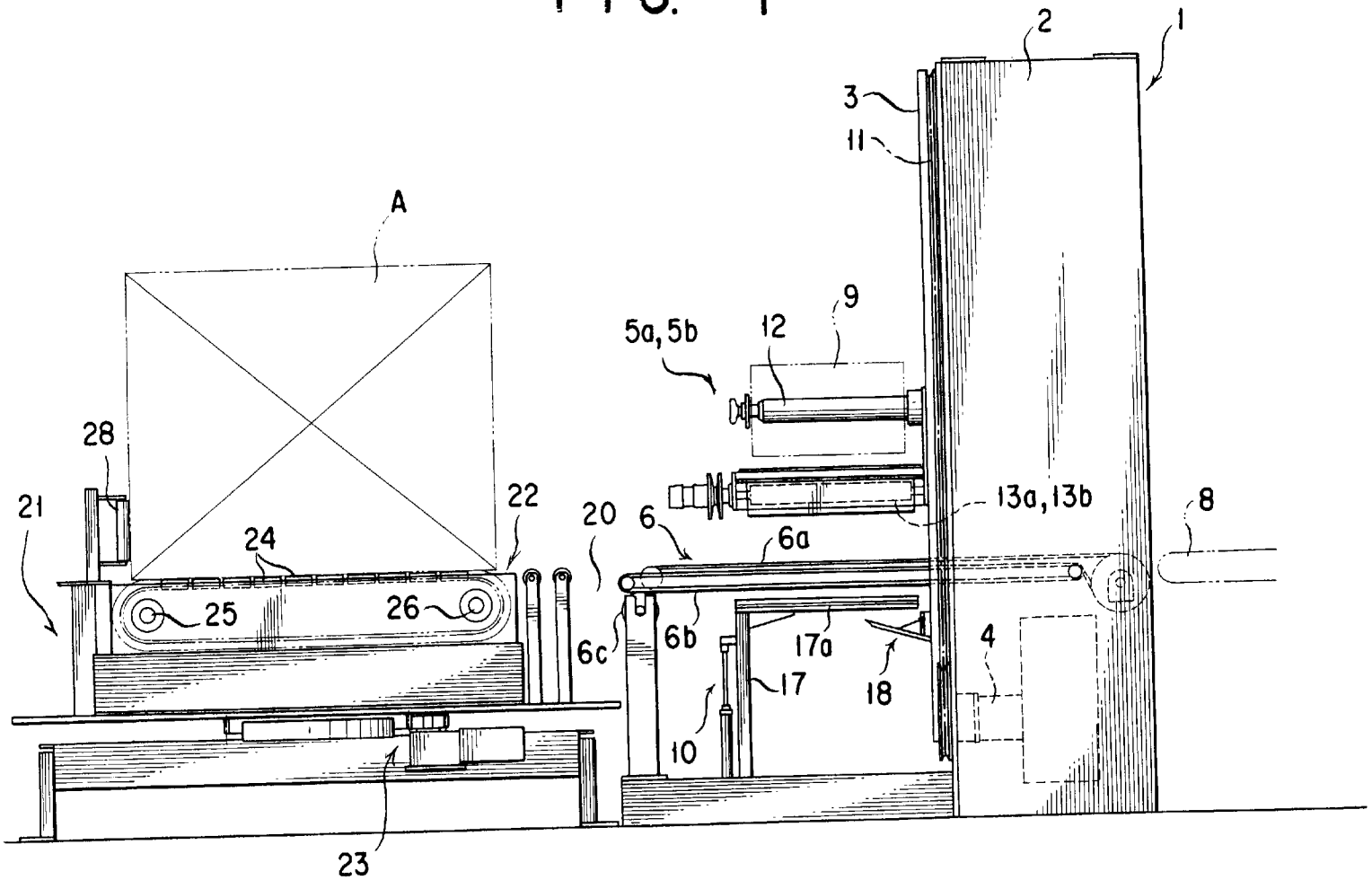
FIG. 1 is a front view illustrating an apparatus that represents a first form of implementation of the present invention.

Referring now to FIGS. 1 to 6, mention is made of an apparatus according to a first form of the present invention illustrated in the form of a ring-type wrapping machine designated by general reference character 1. Included in the ring-type wrapping machine 1 are in general: a rotary ring 3 supported from a frame 2 rotatably about its horizontally extending axis; a rotation drive motor 4 for rotationally driving the rotary ring 3; a pair of film feeders 5*a* and 5*b* attached to and carried by the rotary ring 3 and positioned thereon symmetrically with respect to an axis of rotation for the rotary ring 3; a first conveyor mechanism 6 disposed below the axis of rotation for the rotary ring 3 and extending in a direction parallel thereto for conveying both a loadable object A and strips of film; a second conveyor mechanism 8 for feeding a loadable object A onto the first conveyor mechanism 6; and a film cutting assembly 10 for cutting film fed from the film feeders 5*a* and 5*b* onto the loadable object A on the conveyor mechanism 6. It should be noted here that the two film feeders 5*a* and 5*b* shown may be replaced by one film feeding mechanism 5.

Such a ring-type wrapping machine 1 as described above belongs to the prior art. And in the apparatus 1, the rotary ring 3 is adapted for rotation by the drive motor 4 via a belt 11. Also in the apparatus 1, the conveyor mechanism 6 includes an object carrying belt 6*a* for carrying a loadable object A to be moved and a pair of belts 6*b* and 6*b* disposed at opposite ends of the object carrying belt 6*a* for carrying film 9 running below the object carrying belt 6*a* and moving the film in the same direction in which the loadable object A is moved. The film carrying belts 6*b* and 6*b* have their upper sides lower than an upper side of the object carrying belt 6*a,* and their lower sides lower than a lower side of the object carrying belt 6*a* so that the film 9 running below the object carrying belt 6*a* comes into contact with the film carrying belts 6*b* and 6*b* that lie below the lower side of the object carrying belt 6*a*.

The object carrying belt 6*a* and the film carrying belts 6*b,* 6*b* are designed to be driven at an identical speed by a drive motor (not shown) therefor but are arranged to be driven in mutually opposite directions. This establishes a state in which the upper side of the object carrying belt 6*a* always moves in the same direction and at the same speed as the lower sides of the film carrying belts 6*b* and 6*b* move. Two motors used to drive the belt 6*a* and the belts 6*b,* 6*b* are designed to be rotatable in both rotary directions.

Figure 3:
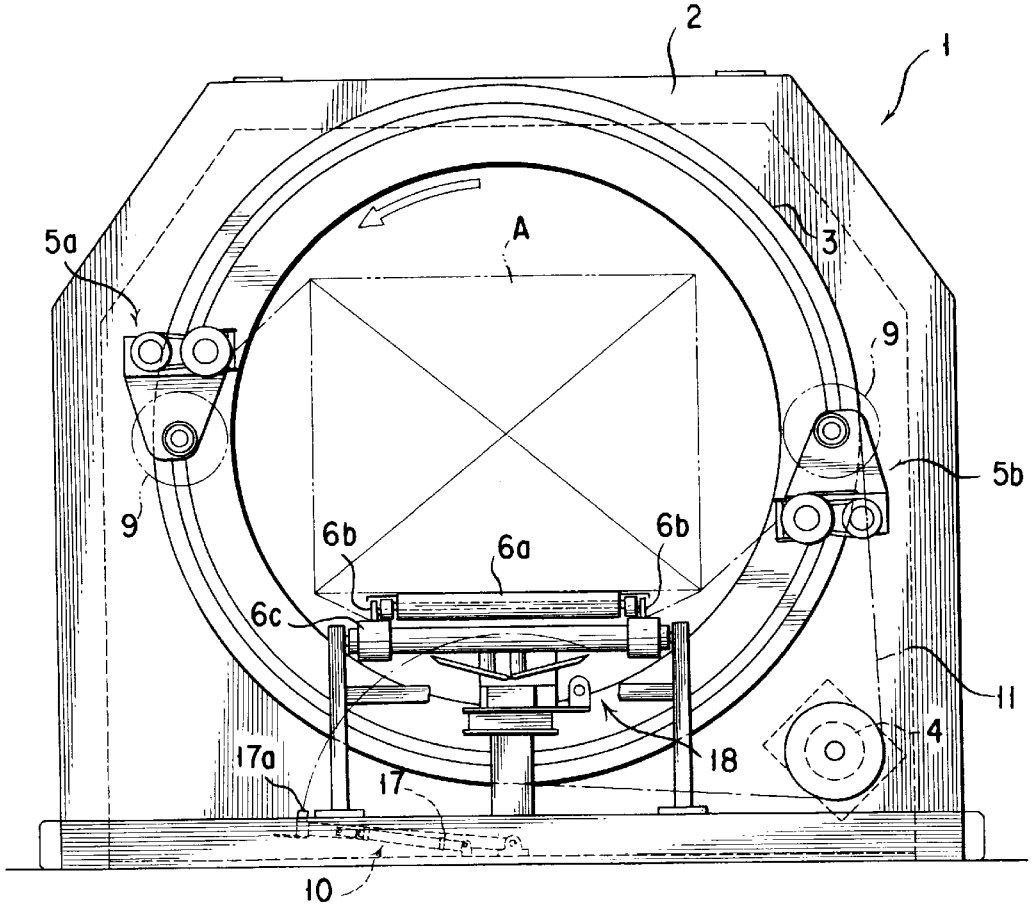
FIG. 3 is an elevational view illustrating a portion of the apparatus as seen from the direction shown by arrows III and III in FIG. 2.
Figure 4:
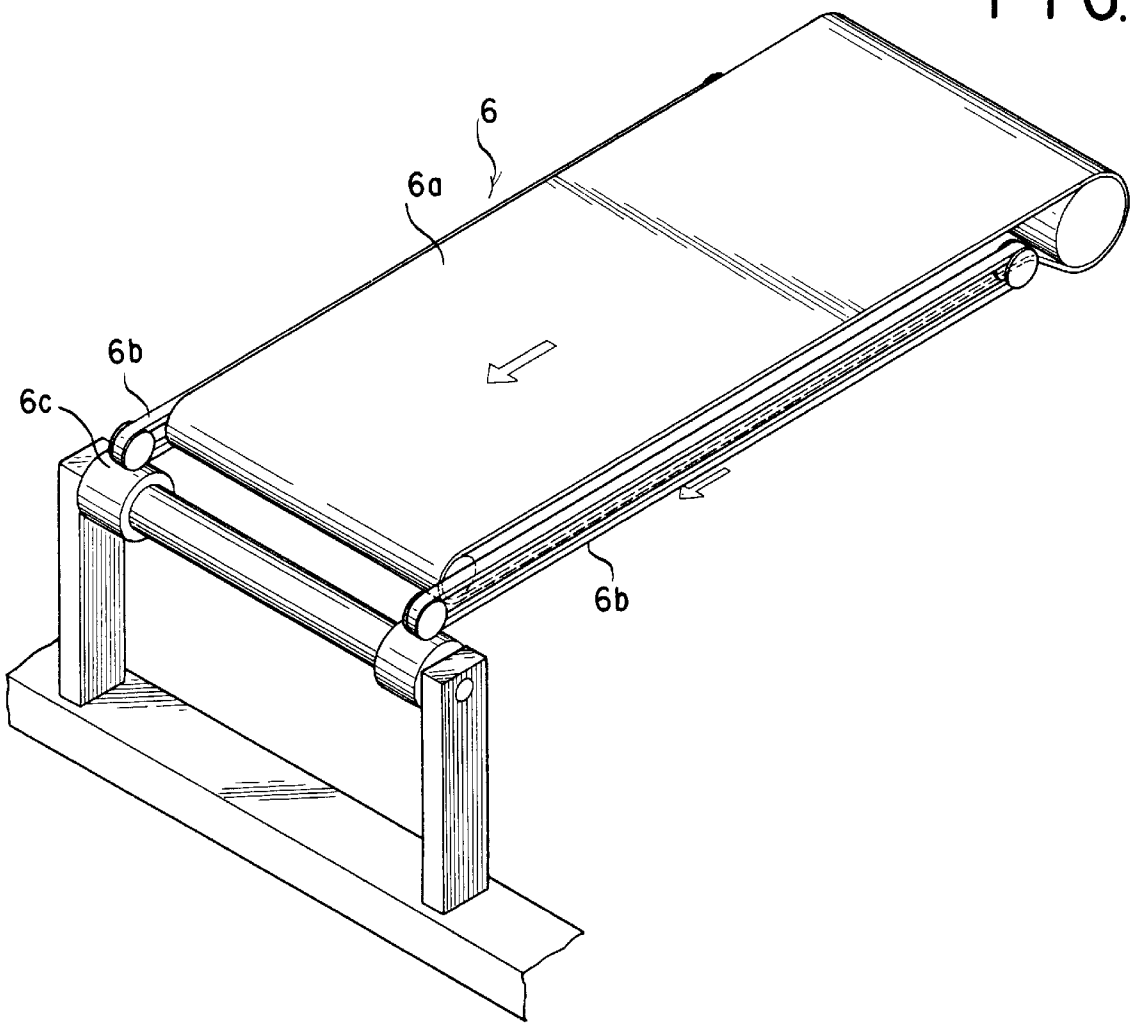
FIG. 4 is a perspective view diagrammatically illustrating a conveyor mechanism included in the apparatus shown in FIGS. 1 and 2.

The conveyor mechanism 6 is supported at its forward end by a support roller 6*c* as shown in FIGS. 1 and 3, and best seen from FIG. 4.

Figure 5:
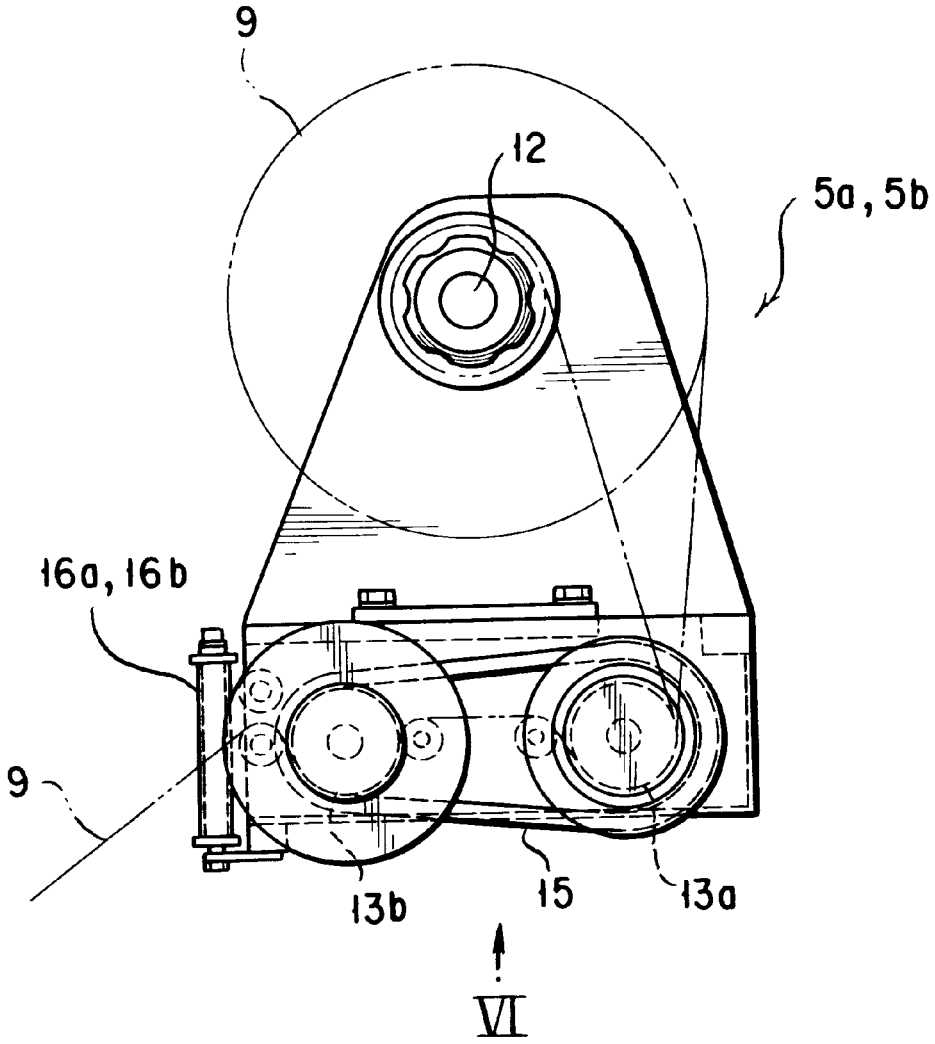
FIG. 5 is an elevational view illustrating a film feeder included in the apparatus shown in FIGS. 1 and 2.

As shown in FIG. 5, the film feeders 5*a,* 5*b* comprise a film support shaft 12 for supporting a roll of film 9, and a pair of draw rollers 13*a* and 13*b,* and are so arranged that film 9 is paid out from the roll supported by the support shaft 12 and is fed out via the two draw rollers 13*a* and 13*b*. In this case, the two draw rollers 13*a* and 13*b* are allowed to rotate by the film 9 being pulled out and are designed so that a difference in rotation is then brought about between them to produce an intense stretching force acting on the film 9. To this end, the two draw rollers 13*a* and 13*b* have pulleys varying in diameter attached thereto and coupled together via a belt 15 as shown to be rotatable in a same direction.

Figure 6:
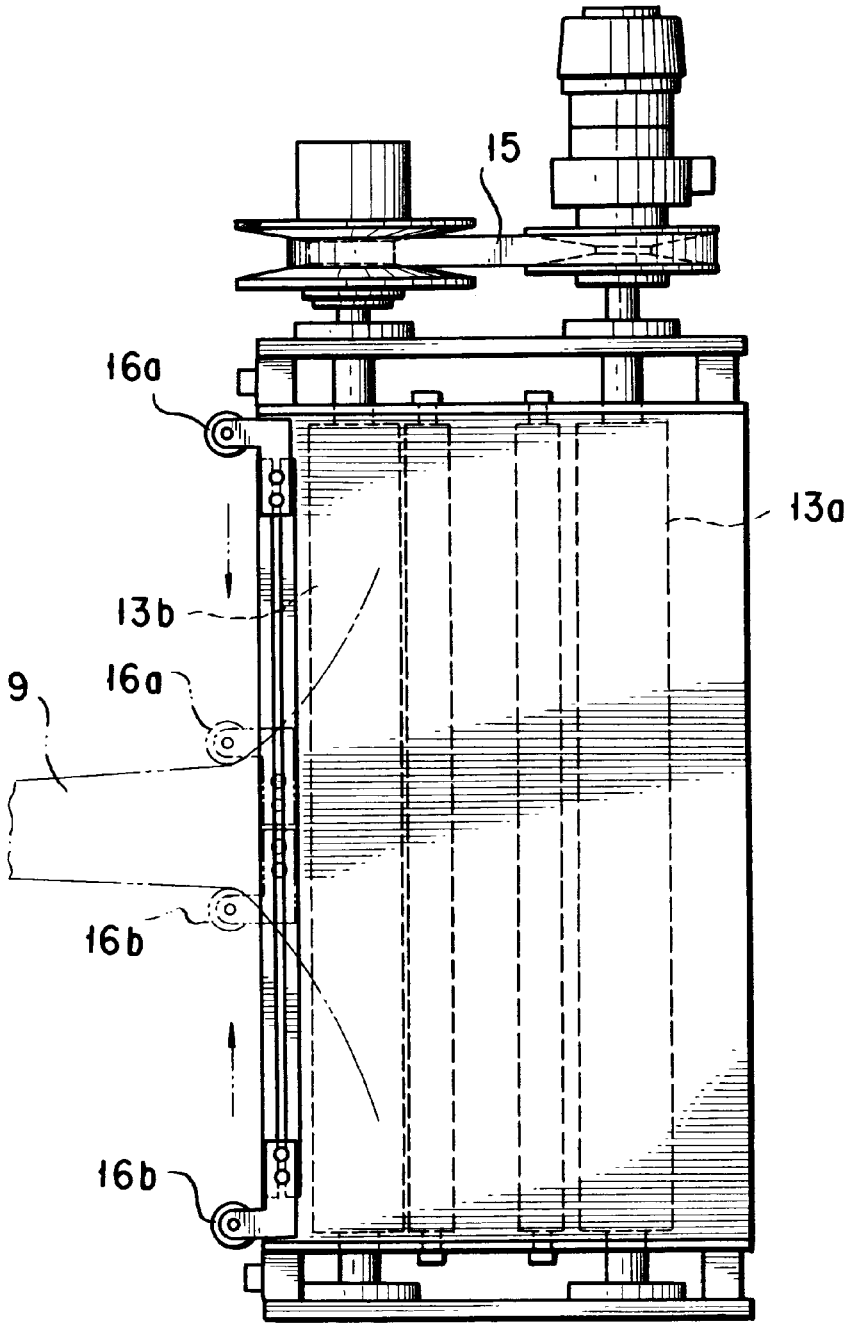
FIG. 6 is a bottom plan view illustrating the film feeder as seen from the direction shown by arrow VI in FIG. 5.

At least one of the film feeders 5*a* and 5*b* is provided with a pair of squeeze rollers 16*a* and 16*b* as shown in FIGS. 5 and 6, which is shown positioned adjacent to the draw roller 13*b* at a film outlet side of the film feeders 5*a,* 5*b*. The squeeze rollers 16*a* and 16*b* are juxtaposed with each other across a width of the film 8 positioned between these rollers, with a spacing between the rollers being adjustable.

Figure 7:
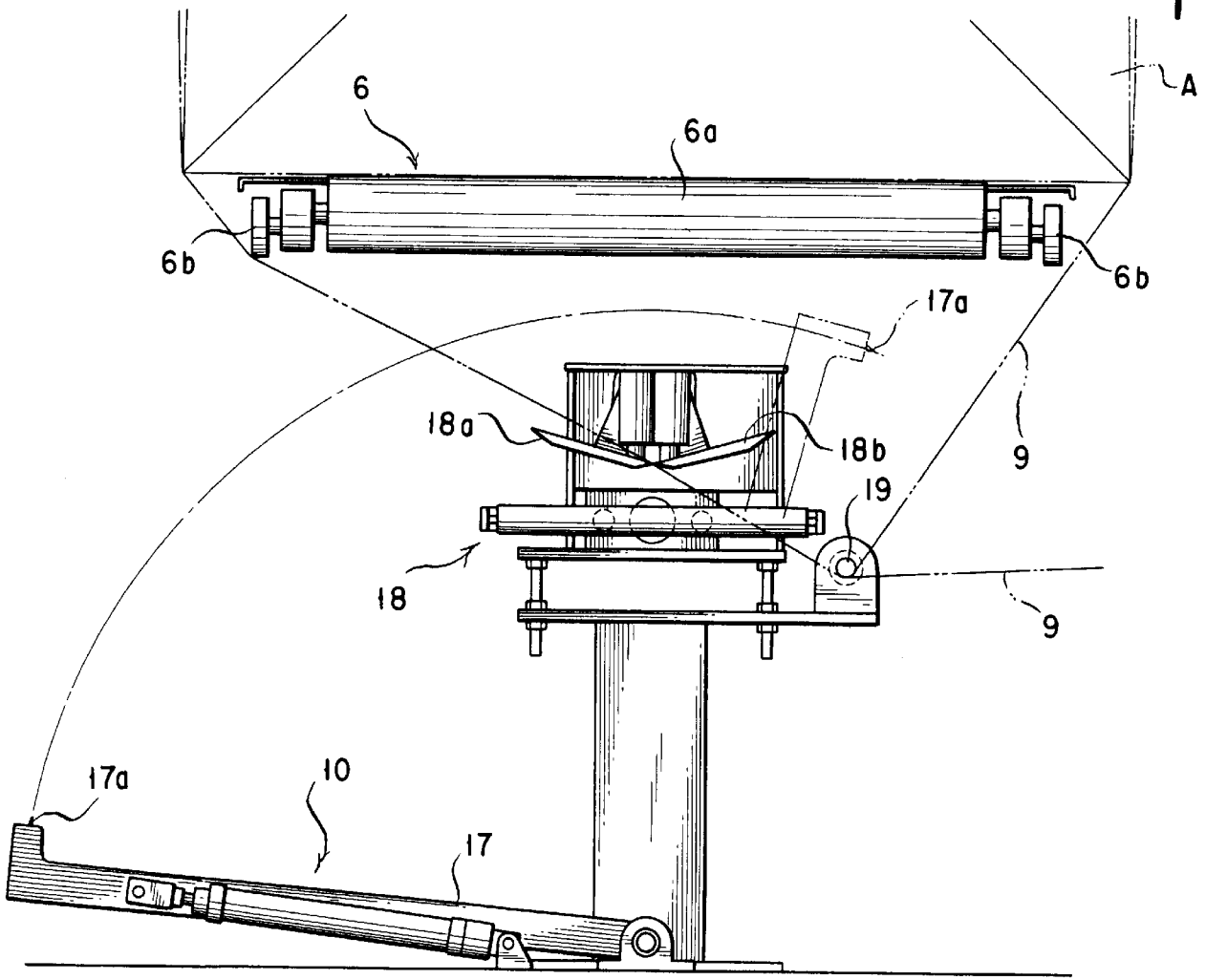
FIG. 7 is an elevational view illustrating a cutting assembly included in the apparatus shown in FIGS. 1 and 2.
Figure 8:
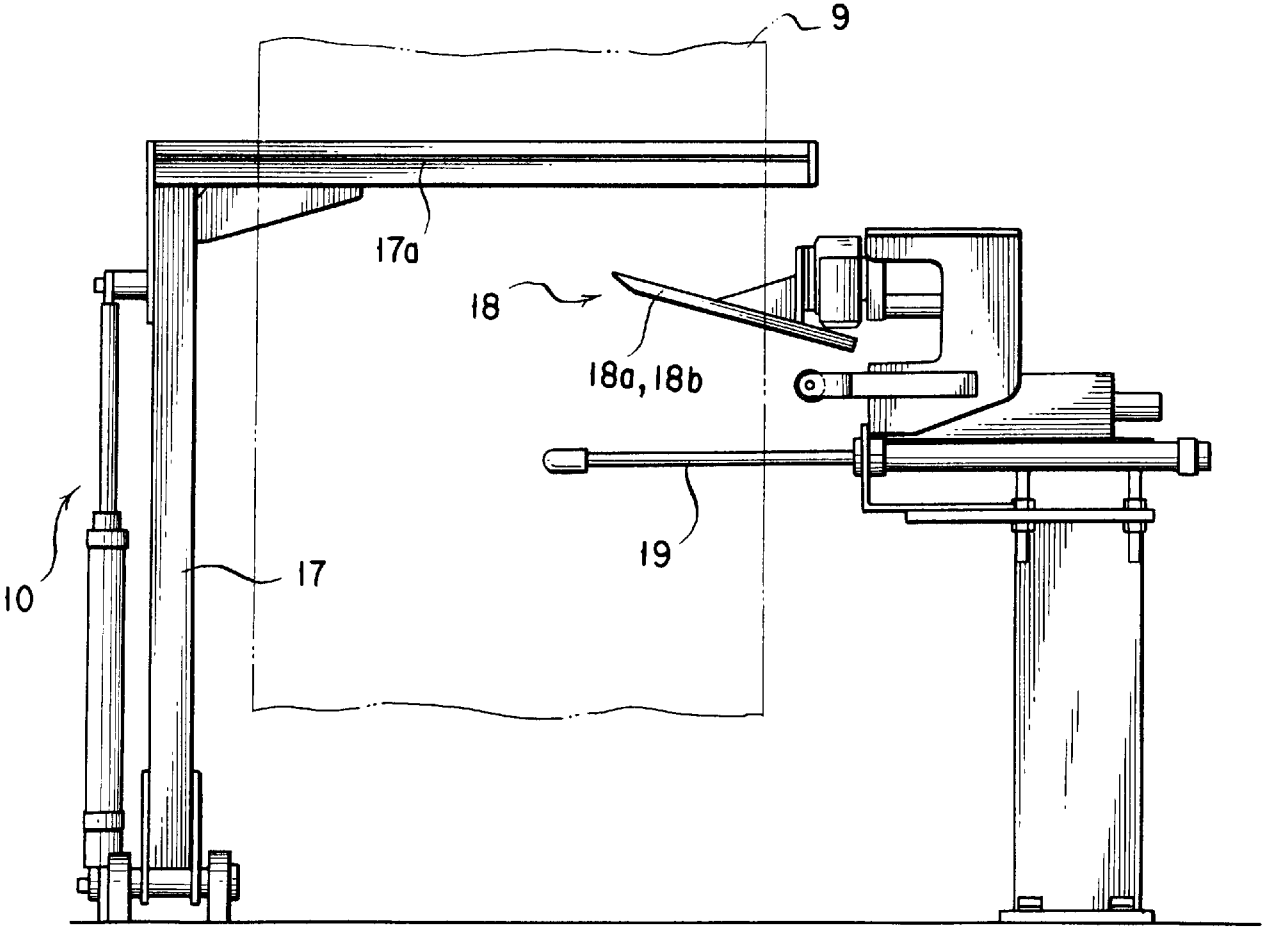
FIG. 8 is a side view of the cutting assembly shown in FIG. 7.
Figure 9:
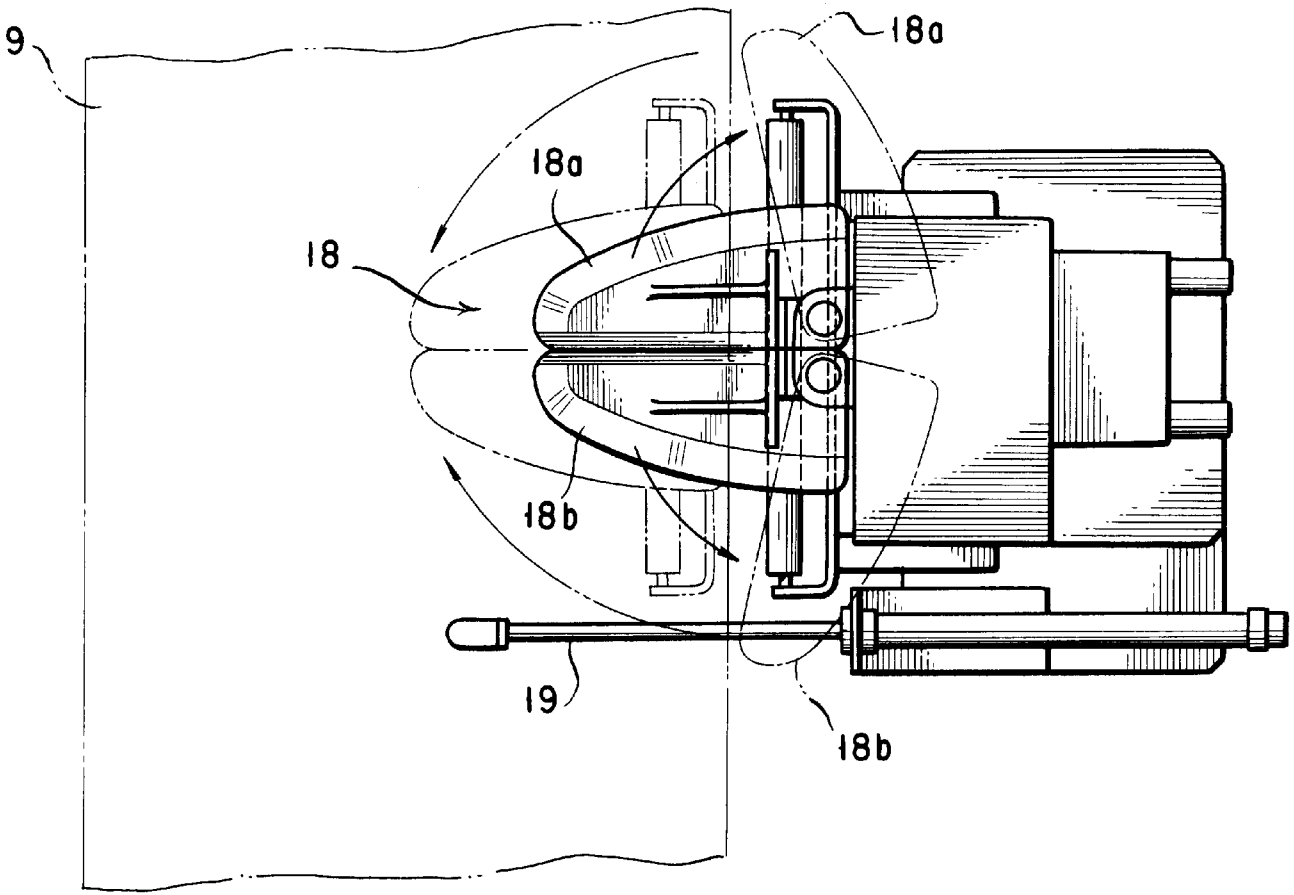
FIG. 9 is a top plan view of a chucking unit included in the apparatus shown in FIGS. 1 and 2.
Figure 10:
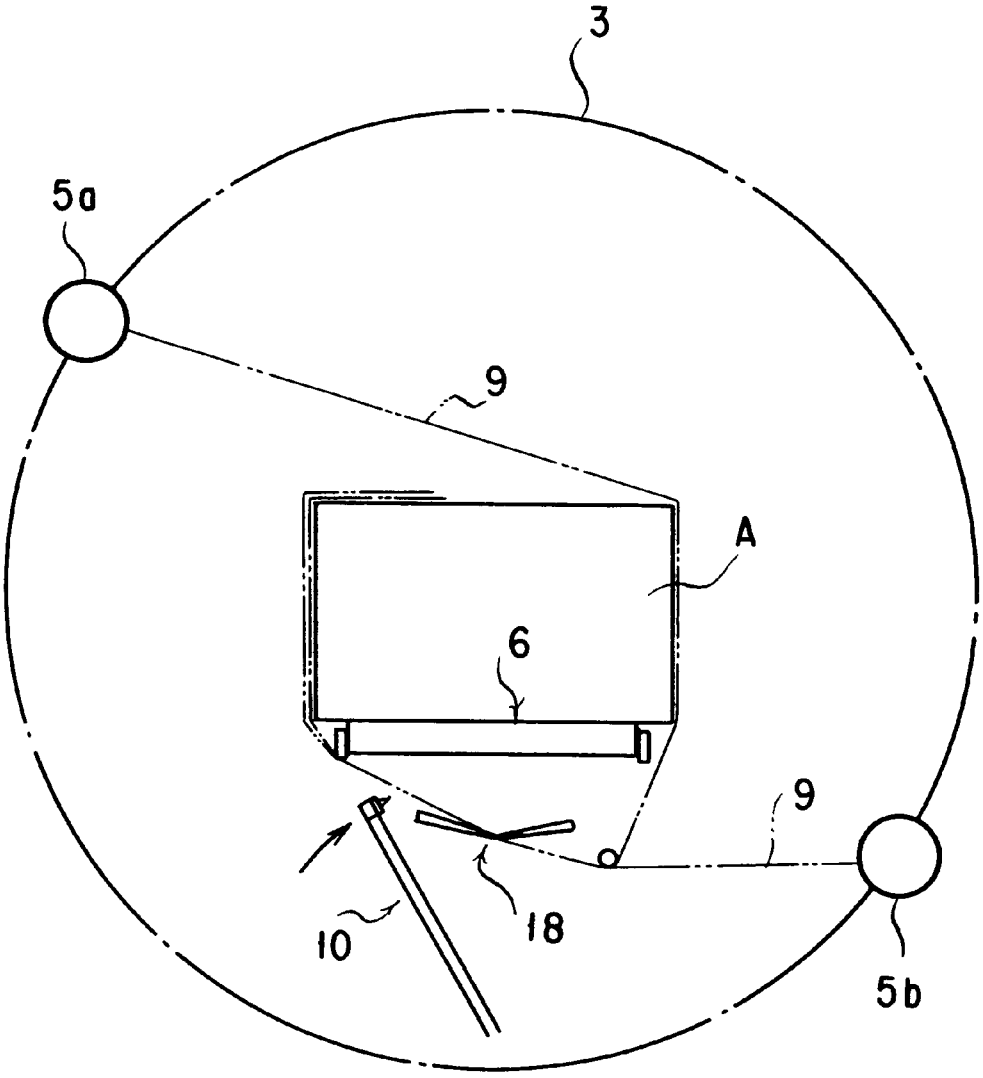
FIG. 10 is a function explanatory view shown for aid in understanding the cutting assembly of the apparatus shown in FIGS. 1 and 2.

A film cutting assembly 10 as seen from FIGS. 1 to 3, 7 and 8 includes a cutter arm 17 that is capable of rotation to move from below the conveyor mechanism 6 to an outside of the rotary ring 3, and a cutter head 17*a* attached at a tip of the cutter arm 17 for cutting the film 9. Associated with the film cutting assembly 10 are a chucking assembly 18 for chucking the film 9 once cut, and a bar 19 for guiding the film 9 for cutting. The chucking assembly 18 as shown in FIGS. 7 and 8 has a pair of chucking edges 18*a* and 18*b* that are rotatable to be brought together to grasp, and thus to chuck, cut film therebetween. During a film winding and object wrapping operation, the chucking edges 18*a* and 18*b* are left swung open right and left so as not to interfere with the film 9. During a film cutting operation, the chucking edges 18*a* and 18 as shown in FIG. 9 are caused to project towards the film 9, and then to rotate inwardly towards each other to chuck the film 9 therewith as shown in FIGS. 7 and 10. The bar 19 is also caused to project as shown in FIGS. 7, 8 and 9 and is provided to facilitate cutting the film 9 by guiding and holding the film.

Figure 2:
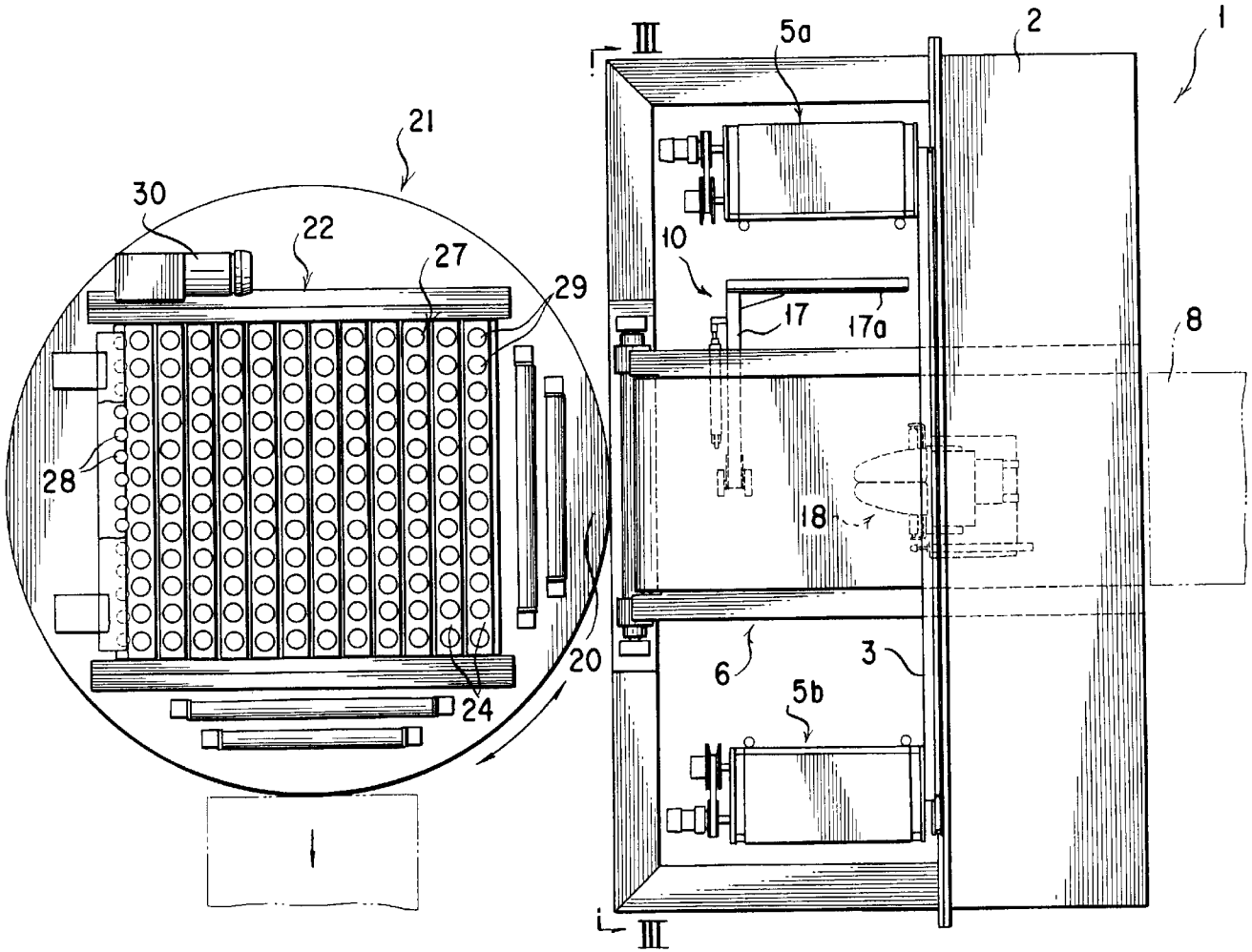
FIG. 2 is a top plan view of the apparatus shown in FIG. 1.

Disposed downstream of the conveyor mechanism 6 in the ring-type wrapping machine 1 is a carrier rotary table assembly 21, which is spaced from the conveyor mechanism 6 with a predetermined spacing 20 in the direction of conveyance as shown in FIGS. 1 and 2. The carrier rotary table assembly 21 comprises a carrier table 22, and a rotary drive 23 for rotating the carrier table 22 horizontally about a vertical axis.

The carrier table 22 includes a conveyor belt 27 that is formed from a large number of elongate plates 24 endlessly joined together with chains, and that is wound on a driving and a driven roller 25 and 26. Disposed as standing adjacent to an end of a conveyance path established by the conveyor belt 27 are a plurality of stopper posts 28. Each of the elongate plates 24 in the conveyor belt 27 has a large number of rolling rollers 29 whose rotating axes are oriented at an angle of 45 degrees with respect to the direction of the conveyance path of the conveyor belt 27 so that when the loadable object A having been conveyed by the conveyor belt 27 hits the stopper posts 28, a repulsive force then produced is transmitted to the rolling rollers 29, which develops a force acting on the object A in a state so as to move the object in a right-angle direction. The stopper posts 28 have their surfaces also provided with a large number of rollers, whereby the loadable object A coming into contact with the stopper posts 28 is allowed to move in such a right-angle direction without having resistance from the contacted posts 28. A carrier table 22 so constructed to operate is publicly known and commercially available and may be made of a carrier table marketed under the trade name "KANTARO" by Toho Kikai Kogyo, Kabushiki Kaisha in Japan. A drive motor 30 connected to the driving roller 25 drives the conveyor belt 27.

The carrier table 22 rests on the horizontal rotary drive 23 and is adapted to rotate by an angle of 90 degrees with respect to the direction of travel of the conveyor mechanism 6 in the ring rotated wrapping machine 1.

Mention is next made of an operation of the first form of implementation of the present invention whose construction is so far described.

First, a loadable object A is conveyed from the conveyor mechanism 8 onto the conveyor mechanism 6 in the ring rotated wrapping machine 1. The loadable object A is conveyed to move towards a downstream of the conveyor mechanism 6. The film cutting assembly 10 has then been displaced to a location where it causes no interference with the film 9 turning round. In this state, the wrapping machine 1 is actuated to wind the film 9 both around the loadable object A and around the conveyor mechanism 6 (belts 6*a* and 6*b*). The film 9 is stretched into the form of a continuous strip, which as the object A moves is wound spirally around the object about the horizontally extending axis of the rotary ring 3. And, those portions of the continuous strip of film 9 that run below the conveyor belts 6*a* and 6*b* move following their movement at the same speed as the object A moves downstream. Those portions of the continuous strip of film 9 that lie below the conveyor belts 6*a* and 6*b* successively come off these belts as the corresponding portions of the loadable object A successively come off the conveyor mechanism 6, as the object moves downstream, when these portions pass across spacing 20 established between the conveyor mechanism 6 and the carrier rotary table assembly 21. Then, a restoring force stored in a stretched strip of film 9 is released to allow the strip of film to be wound densely around the loadable object A tightly. And, in a state in which the loadable object A has been fully wound with the strip of film 9 over a total length of movement of the loadable object A in its direction of movement, the film cutting assembly 10 is actuated to cut the strip of film 9, and a cut end of the strip of film is chucked by the chucking assembly 18. See FIGS. 7 to 10.

The loadable object A conveyed from the conveyor mechanism 6 is accepted onto the carrier table 22 in the carrier rotary table assembly 21, and then carried thereon by the conveyor belt 27 as the object comes into contact with the stopper posts 28.

However, before the loadable object A comes into contact with the stopper posts 28, the rotary drive 23 rotates the carrier table 22 by an angle of 90 degrees in a rotary direction that permits movement of the loadable object A, immediately later produced by the rolling rollers 29, to be headed towards the conveyor mechanism 6 in the ring rotated wrapping machine 1.

Figure 13:
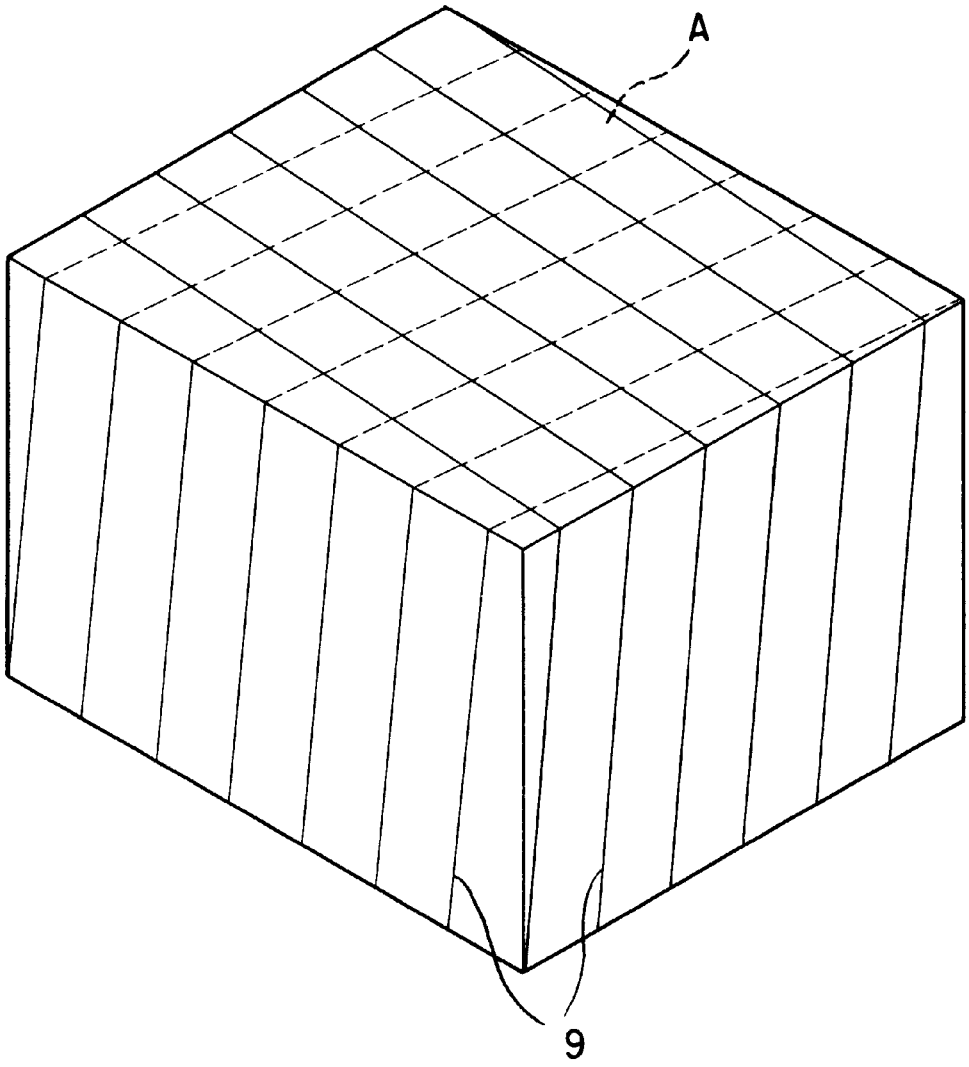
FIG. 13 is a perspective view illustrating an object wrapped with a strip of film.

Continuing conveyance by the conveyor belt 27 in the carrier table assembly 22 causes the rolling rollers 29 to turn movement of the loadable object A upon hitting the stopper posts 28, and then causes the loadable object A to move back towards the ring rotated wrapping machine 1. Now, operating the ring rotated wrapping machine 1 in the same manner as mentioned previously, except that the direction of conveyance of the conveyor mechanism 6 is reversed, causes the loadable object A horizontally turned by 90 degrees coming from the carrier table 22 to travel backwards on the conveyor mechanism 6, and during this course another continuous strip of film 9 is wound again spirally around that loadable object A about the same horizontal axis as mentioned before. As a result of these operations, the loadable object A in the form of a rectangular parallelepiped or hexahedron as shown in FIG. 13, has its side surfaces fully covered with strips of film 9 and its upper and lower surfaces fully and doubly covered with strips of intersecting film 9.

Where wrapping executed concurrently with a reversed run has been accomplished, the continuous strip of film 9 is cut and the conveyor mechanism 6 is normally driven to feed the wrapped loadable object A downstream towards the carrier rotary table assembly 21 in which the carrier table 22 that has been retuned to its original position conveys the wrapped loadable object A received from the conveyor mechanism 6 until it contacts the stopper posts 28. Then, continuing conveyance by conveyor belt 27 causes the wrapped loadable object A to be swept away sideways.

Repeating the foregoing operations produces a series of wrapped loadable objects each in the form of a rectangular parallelepiped, each having its side surfaces fully covered with first or second continuous strips of film 9, and its upper and lower surfaces fully and doubly covered with both the first and second strips of film 9 in an intersecting manner. As a matter of course, winding need not be limited to two strips of film, and many include more than two strips of film.

Figure 11:
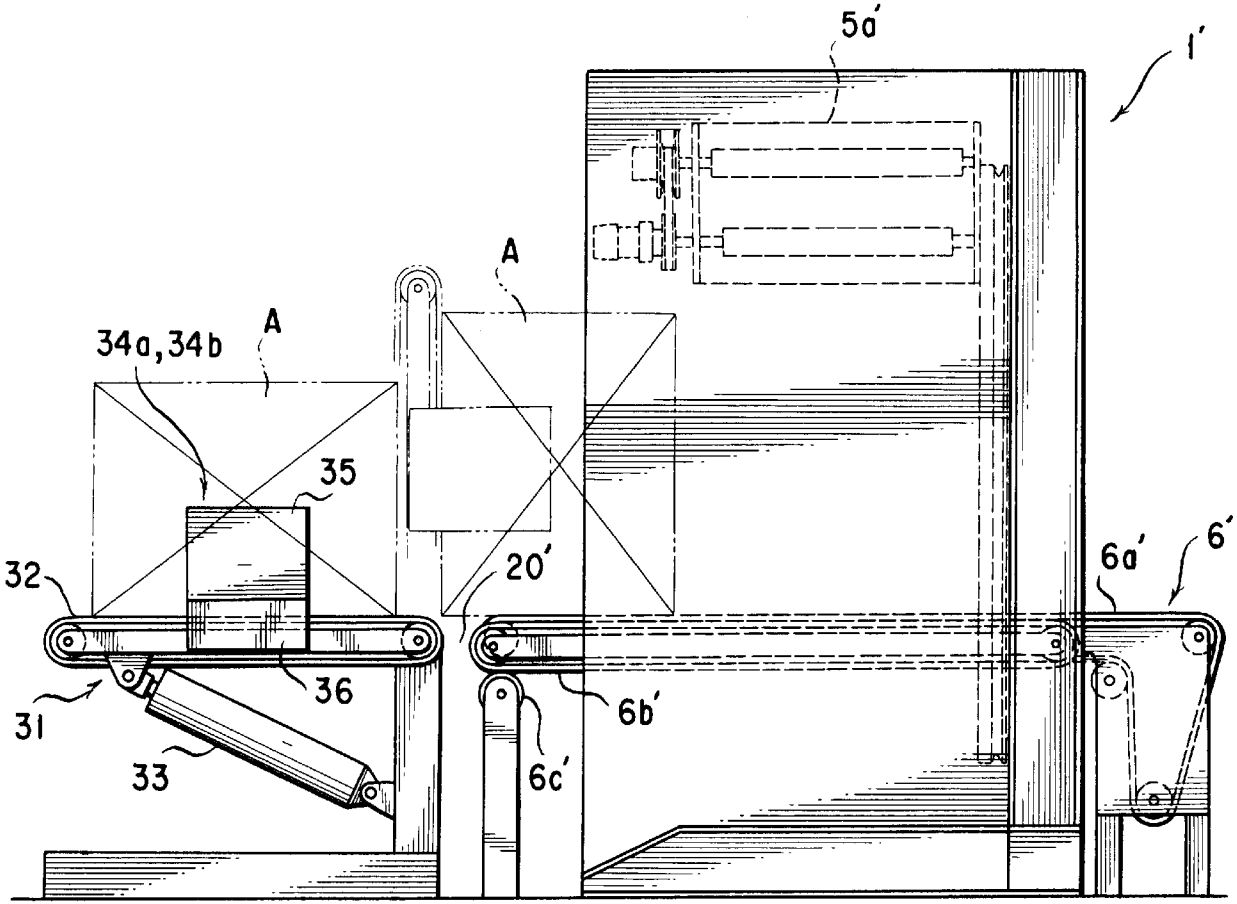
FIG. 11 is a front view illustrating an apparatus that represents a second form of implementation of the present invention.
Figure 12:
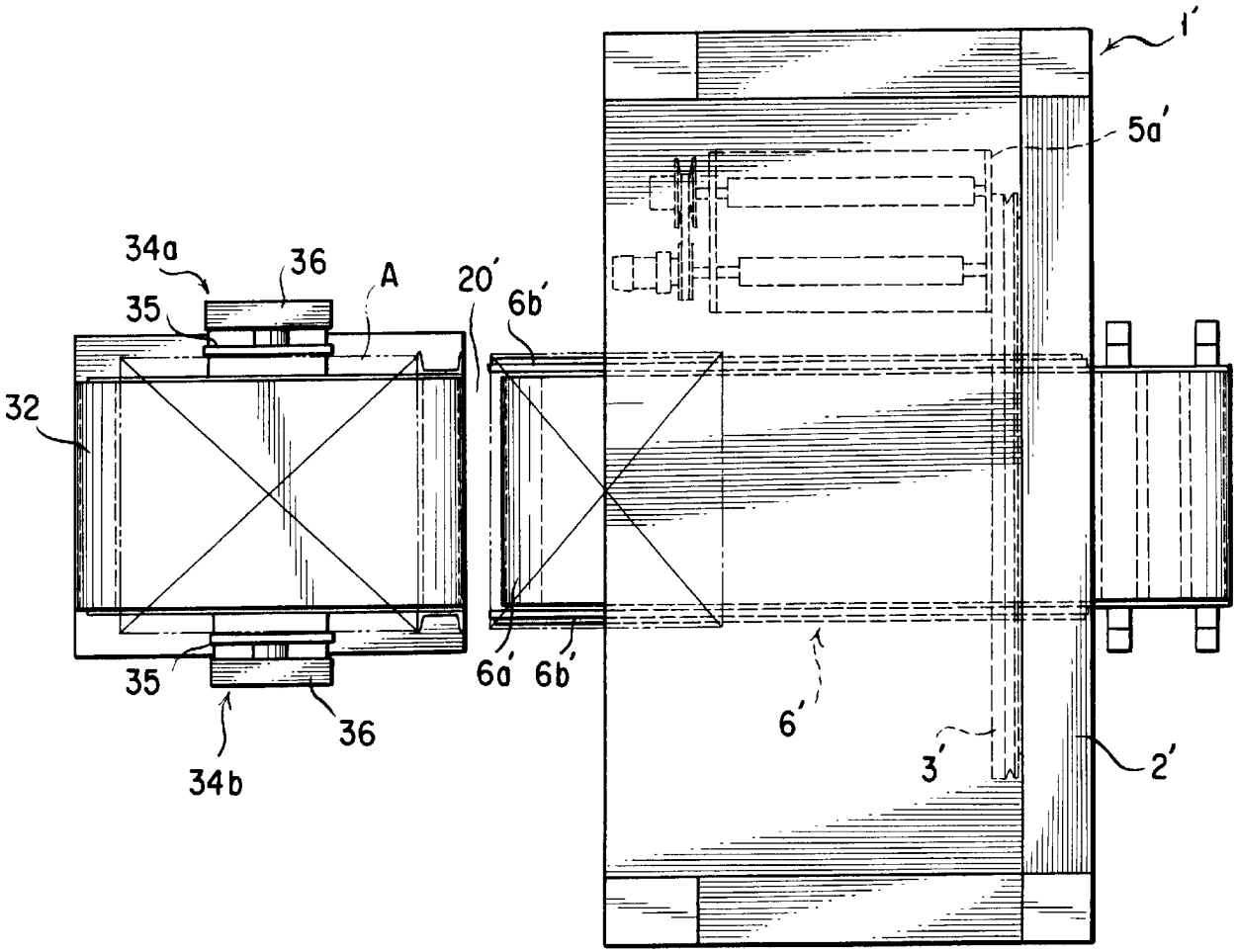
FIG. 12 is a top plan view of the apparatus shown in FIG. 11.

FIGS. 11 and 12 show a loadable object wrapping apparatus according to a second form of implementation of the present invention, again using as its component a ring rotated wrapping machine, here designated by general reference character 1'. The ring rotated wrapping machine 1' shown in FIGS. 11 and 12 may be considered to be identical to the ring rotated wrapping machine 1 shown in FIGS. 1 to 10. Accordingly, in the following description components of the ring rotated wrapping machine 1' shown in FIGS. 11 and 12 according to the second form of implementation of the present invention carry the same reference characters as in FIGS. 1 and 2 distinguished by a prime "'", and repeated explanations thereof are omitted. It should also be noted that one film feeder 5*a*' shown may be replaced by two film feeders.

Downstream of conveyor mechanism 6' in the ring rotated wrapping machine 1'*a* rotary table 31 is disposed and juxtaposed therewith across a spacing 20' in a direction of conveyance of a loadable object A. The rotary table 31 includes a conveyer belt 32 adapted to travel in the same direction as the conveyer belts 6*a*' and 6*b*' of the conveyor mechanism 6'. And, this rotary table 31 is designed to be rotatable about an upstream end of the conveyer belt 32 in a vertical plane from its horizontal position until it stands vertically. The rotary table 31 is so rotatable by a cylinder actuator.

The rotary table 31 also has a pair of holders 34*a* and 34*b* designed to hold the loadable object A on the rotary table 31 from its opposite sides. Each of the holders 34*a* and 34*b* comprises a holder plate 35 in contact with the loadable object A, and a drive 36 for moving the holder plate 35.

In operation of the apparatus according to the second form of implementation of the present invention shown in FIGS. 11 and 12, a loadable object A is carried by a conveyor not shown onto the conveyor mechanism 6'. And, the loadable object A is advanced downstream by the conveyor mechanism 6'. The ring rotated wrapping machine 1' is then operated to wind film 9 from the film feeder 5*a*' around both the loadable object A and the conveyer belts 6*a*' and 6*b*' of the conveyor mechanism 6'. Then, film 9 is stretched into a continuous strip of film, which is spirally wound around the loadable object A as the latter is advanced on the conveyer belt 6*a*'. And, as the film support conveyor belts 6*b*' and 6*b*' move, those portions of the continuous strip of spiraled film that run below these conveyor belts, and are carried thereby, are moved therewith at the same speed as the loadable object A moves. And, as the loadable object A successively comes off the conveyor mechanism 6' and downstream thereof, those portions of the continuous strip of film 9 also successively come off, with a restoring force stored in the strip of film, when released, permitting the continuous strip of film 9 to be densely wound around the loadable object A tightly. Then, a cutter is actuated to cut an end of the continuous strip of film 9 wound on the loadable object A over its entire length to separate the end from film 9 in the film feeder 5*a*', and to allow a chucking assembly to chuck the separated end of film extending from the film feeder 5*a*'.

The loadable object A that leaves the conveyor mechanism 6' is now received by the rotary table 31. When the entire body of the loadable object A comes to lie on the rotary table 31, the conveyor belt 32 is at a standstill and the holder 34*a* and 34*b* are actuated to firmly hold the loadable object A on the rotary table 31. Then, the cylinder actuator 34 is operated to rotate the rotary table 31 in a vertical plane until it stands upright, after which the loadable object A is released from being held by the holders 34*a* and 34*b*.

Figure 14:
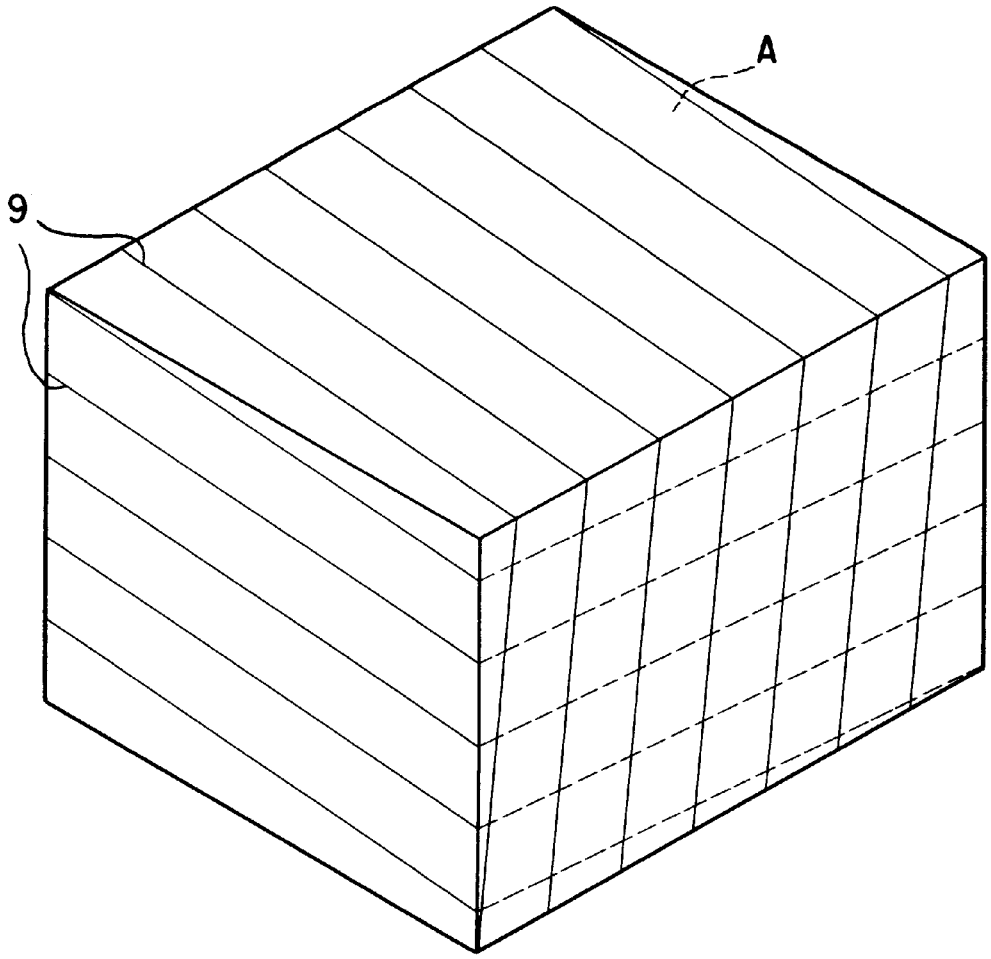
FIG. 14 is a perspective view illustrating an object wrapped with a strip of film.

Now, the loadable object A having been rotated by an angle of 90 degrees thereof in the vertical plane lies on or across a downstream end of the conveyor mechanism 6' of the ring-rotated wrapping machine 1'. In this state, the conveyor mechanism 6' of the ring-rotated wrapping machine 1' is reversely driven. This causes the loadable object A, reoriented by 90 degrees in the vertical plane from its previous orientation, to be moved by the conveyor belt 6*a*' in a reverse direction. While the loadable object A is so moving, the ring-rotated wrapping machine 1' is operated to wind a continuous strip of film 9 from the film feeder 5*a*' spirally around the loadable object A. As a result, the loadable object A in the form of a rectangular parallelepiped or hexahedron as shown in FIG. 14, has its sides, upper and lower surfaces fully covered with strips of film 9 and its front and rear surfaces fully and doubly covered with intersecting strips of film 9.

Where wrapping executed concurrently with a reversed run has been accomplished, the continuous strip of film 9 is cut and the conveyor mechanism 6' is normally driven to feed the wrapped loadable object A downstream towards the rotary table 31 that has been retuned to its original horizontal position, which rotary table receives the wrapped loadable object A from the conveyor mechanism 6'.

Figure 15:
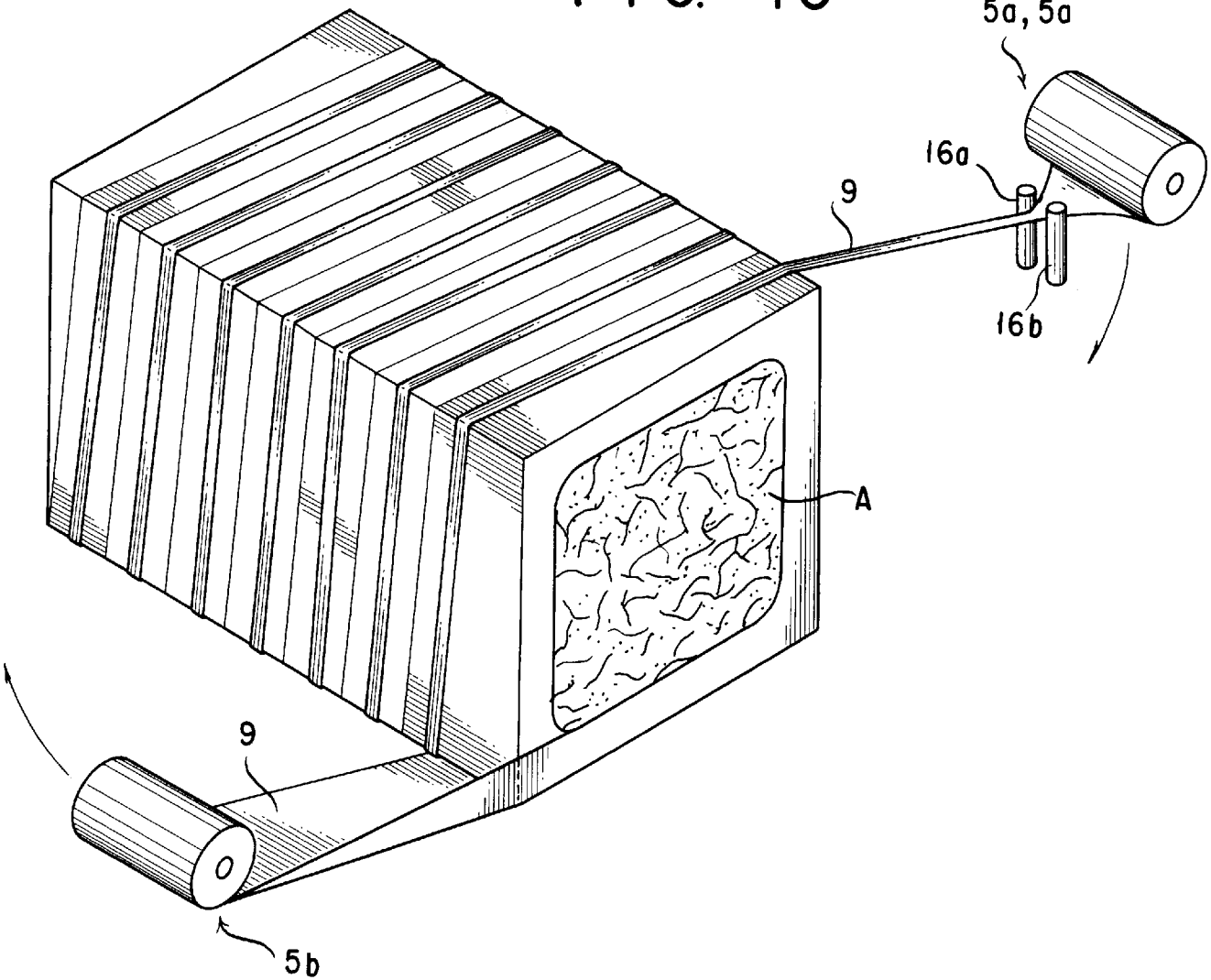
FIG. 15 is a perspective view illustrating a state in which a strip of film paid out from a film supplying machine is formed into a string of film for winding around a loadable object.

In both of the two forms of implementation of the present invention described above, it is possible to form a continuous strip of film 9 from or in one of film feeders 5*a*, 5*a*' into a continuous string of film, and to cause the loadable object A to be wound therewith. Thus, as shown in FIG. 15 the one of film feeders 5*a*, 5*a*' has a pair of squeeze rollers 16*a*, 16*b*, with a narrowed spacing between them, to feed out film 9 in the form of a continuous string while the other film feeder 5*b* is adapted to feed out film 9 in the form of a continuous wider strip. The loadable object A is thus wound spirally with both forms of film 9 simultaneously, but has right-angled corner surfaces of both its sides covered with the continuous wider continuous strip of film 9 as shown in FIG. 15.

Figure 16:
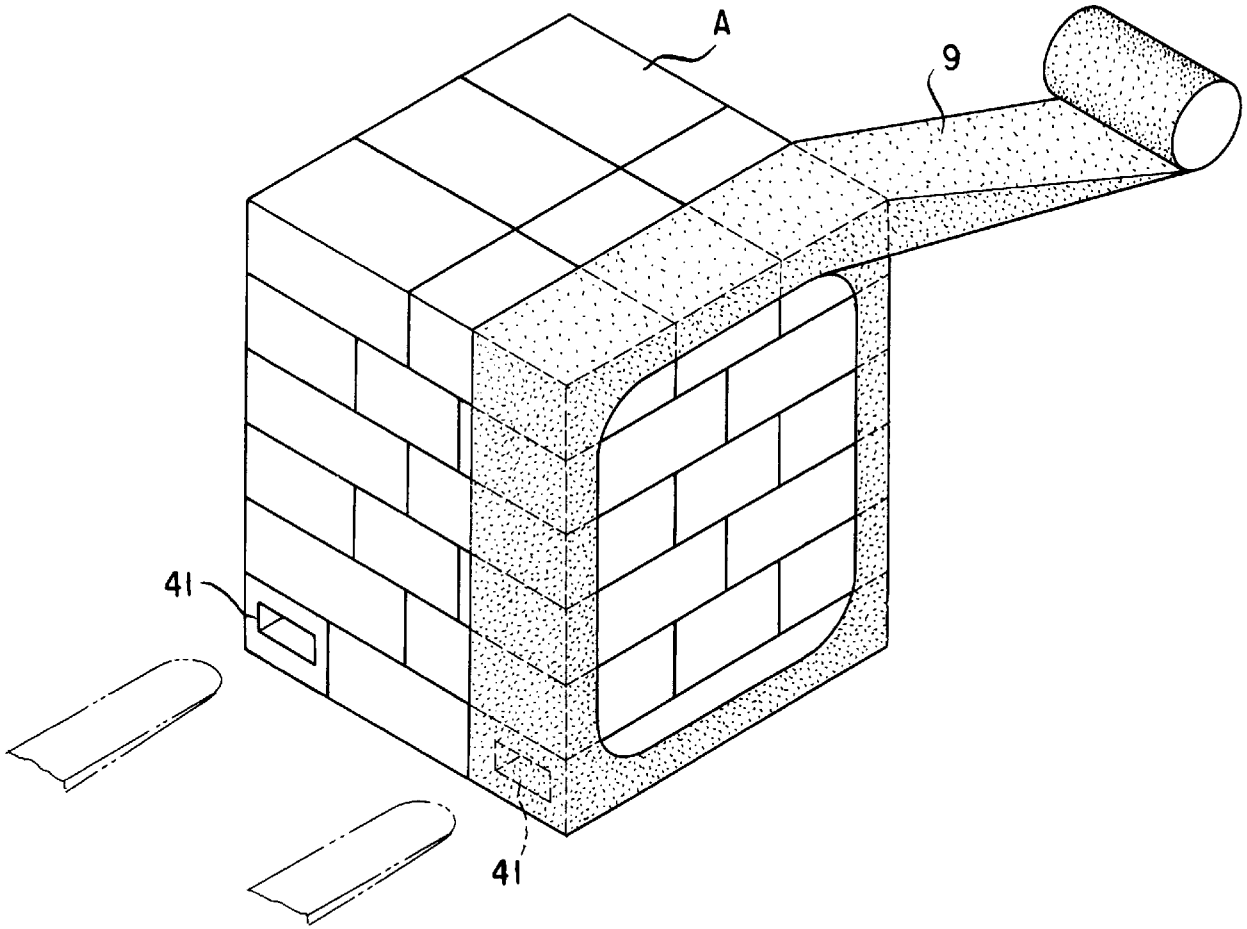
FIG. 16 is a perspective view illustrating a state in which an object together with a sleeve pallet is being wrapped.

Also in both of the two forms of implementation of the present invention described above, when a loadable object A is placed on the conveyor mechanism 6, 6' of the ring-rotated wrapping machine 1, 1' using a forklift, as shown in FIG. 16, it is advantageous to use a pair of sleeve pallets 41 and 41, which are prepared to receive thereon and therebetween the loadable object A such that there may be a rectangular parallelepiped (hexahedron) stack of a number of rectangular solid blocks, such as boxes laid snugly one by and on another as shown. The two sleeve pallets 41 and 41 have their sleeves adequate in size and position to accept forks of the forklift, when a rectangular solid stack loadable object A is placed on the sleeve pallets 41 and 41 that are spaced apart from each other and positioned so their two outer side surfaces become flush with corresponding side surfaces of the rectangular solid stack loadable object A. If the loadable object A is so placed with the sleeve pallets 41 and 41 on the conveyor mechanism 6, 6', film 9 can be spirally wound and thereby wrapped around both the loadable object A and the sleeve pallets 41. With the loadable object A and the sleeve pallets 41 so wrapped together and replaced onto the rotary table 31, the forks of the forklift can break through the film 9 and can then be received by the sleeves of the sleeve pallets 41 for transport of the loadable object A. Thus, this arrangement facilitates transporting a loadable object A.

It will be apparent to those skilled in the art that such sleeve pallets need not be two separate sleeve pallets 41 and 41, but may be substituted by a pallet which has two sleeve bodies joined together by plates like an ordinary pallet. The sleeve pallets 41, 41 may be made of, for example, paper board.

The present invention enables a rectangular parallelepiped loadable object over its entire six surfaces to be wound and thereby wrapped with film. Even more important, this can be done quite simply, just by advancing forth and back the loadable object through a film feeder device.

An apparatus for practicing methods according to the present invention is simple, too. In addition to a conventional ring-rotated wrapping machine, the apparatus only requires a device to be provided downstream of the ring-rotated wrapping machine that rotates orientation of a loadable object by 90 degrees in a horizontal or vertical plane, and hence is simple in construction.

Also, if more than one film feeder is employed to wind film supplied therefrom around a loadable object, forming a continuous strip of film from one of the film feeders into a continuous string of film gives rise to a wrapped loadable object of increased wrapping strength.

Further, winding film around both a loadable object and a sleeve pallet structure facilitates transporting a wrapped loadable object, and loading and unloading operations using a forklift.

Figure 17:
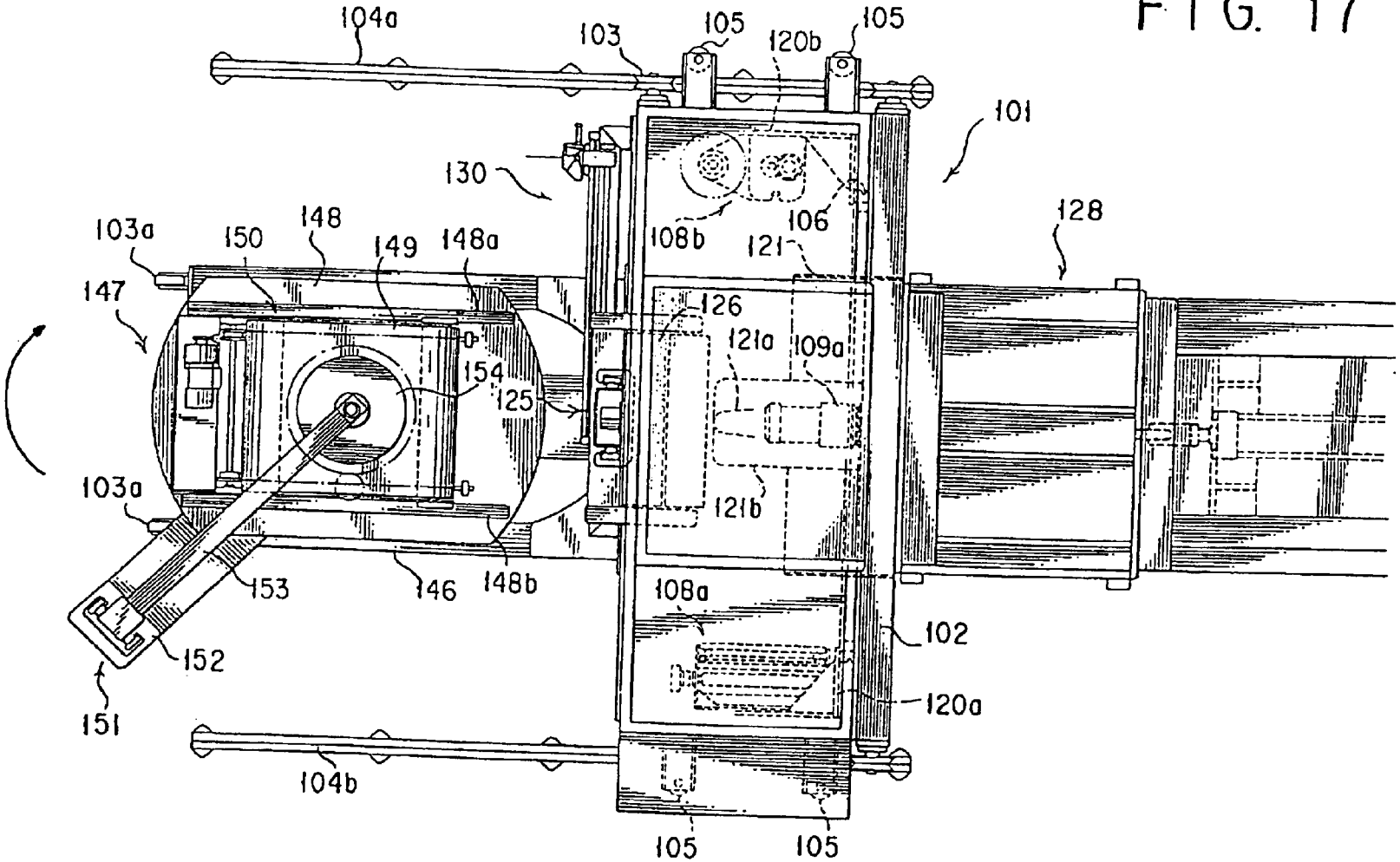
FIG. 17 is a top plan view illustrating an apparatus according to a third form of implementation of the present invention.
Figure 18:
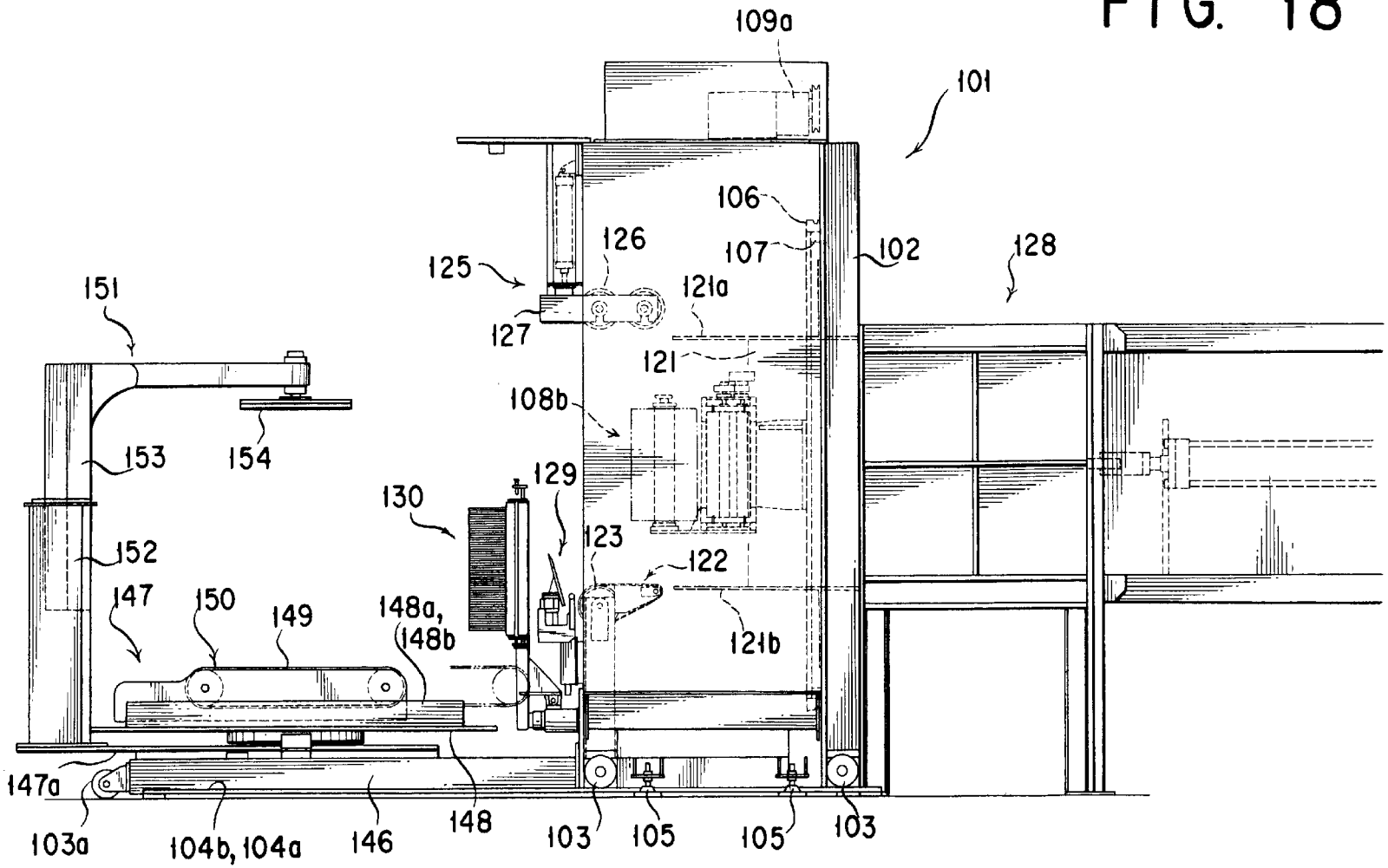
FIG. 18 is an elevational view of the apparatus shown in FIG. 17.
Figure 19:
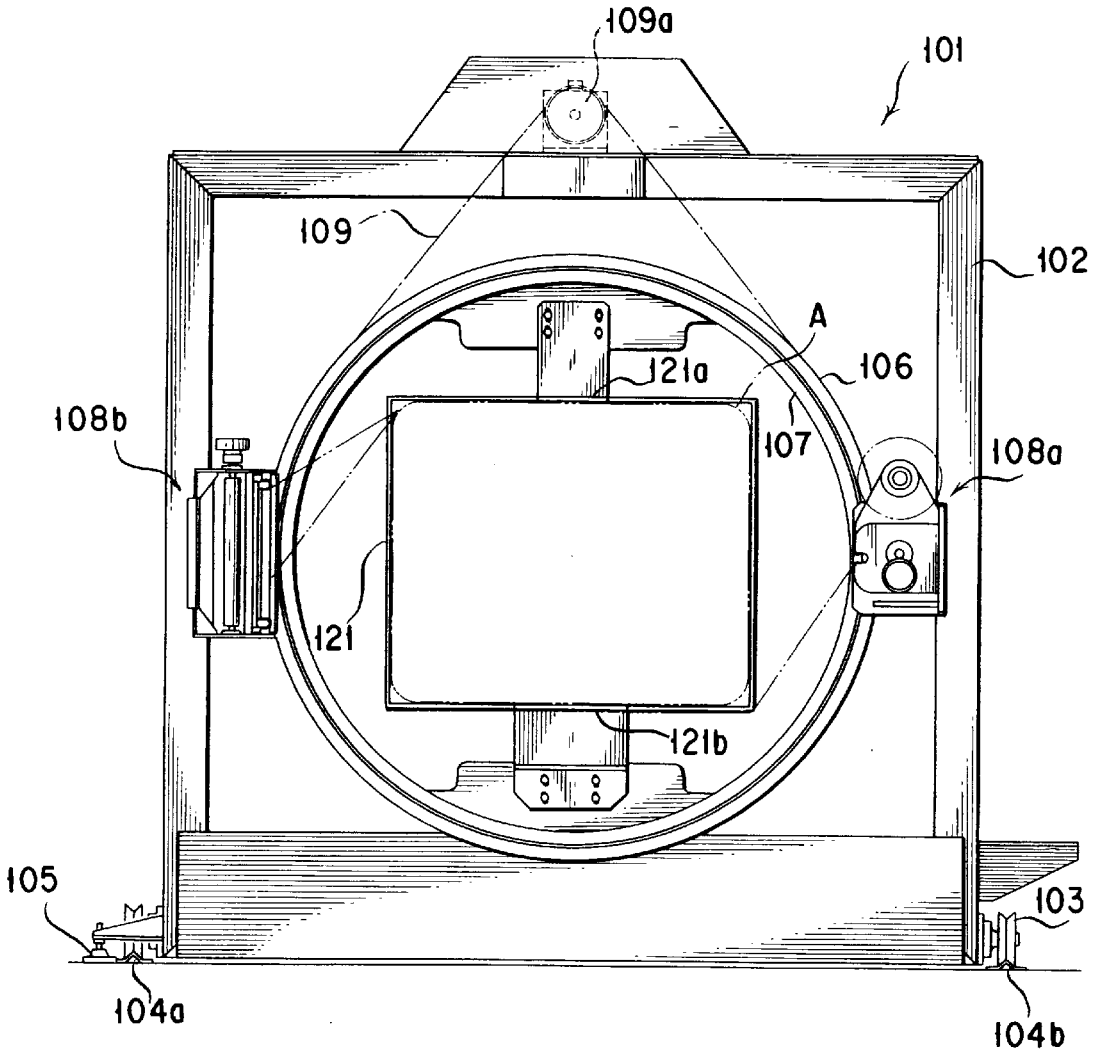
FIG. 19 is a front view illustrating a ring-rotated wrapping machine shown in FIG. 18 in which its front side is omitted from illustration.

An explanation is next given with respect to a third form of implementation of the present invention with reference to FIGS. 17 to 29. In FIG. 17, reference numeral 101 designates a ring-rotated wrapping machine and reference numeral 102 denotes a frame thereof. The frame 102 is of a portal or gantry type and is carried by rollers 103 located beneath left and right hand sides thereof. The rollers 103 are carried by rails 104*a* and 104*b* on a floor so as to be capable of rolling on these rails to advance the frame forwards and backwards (in the left and right hand directions as shown in FIG. 17). The frame 102 is fixed at a given position by a retainer 105.

Disposed within an interior of the frame 102, and rearwardly in a direction of forward movement of the frame 102, is a rotary ring 106 in the form of a ring that is supported by the frame 102 via a rotary bearing 107 so as to be rotatable about a horizontal axis extending in the forward and backward direction of the frame 102. And, the rotary ring 106 has a pair of film feeders 108*a* and 108*b* attached thereto and deviated in angular position by 90 degrees relative to one another. The rotary ring 106 also has a belt 109 wound around its outer periphery, and is rotated via this belt by a motor 109*a* mounted on the frame 102.

The two film feeders 108*a* and 108*b* may be of a same design and are mounted to the rotary ring 106 so as to be deviated in orientation relative to one another by 90 degrees. Accordingly, so mounted, one film feeder 108*a* has a film roll whose axis extends parallel to the axis of rotation of the rotary ring 106, while the other film feeder 108*b* has a film roll whose axis extends perpendicularly to the axis of rotation of the rotary ring 106.

Figure 20:
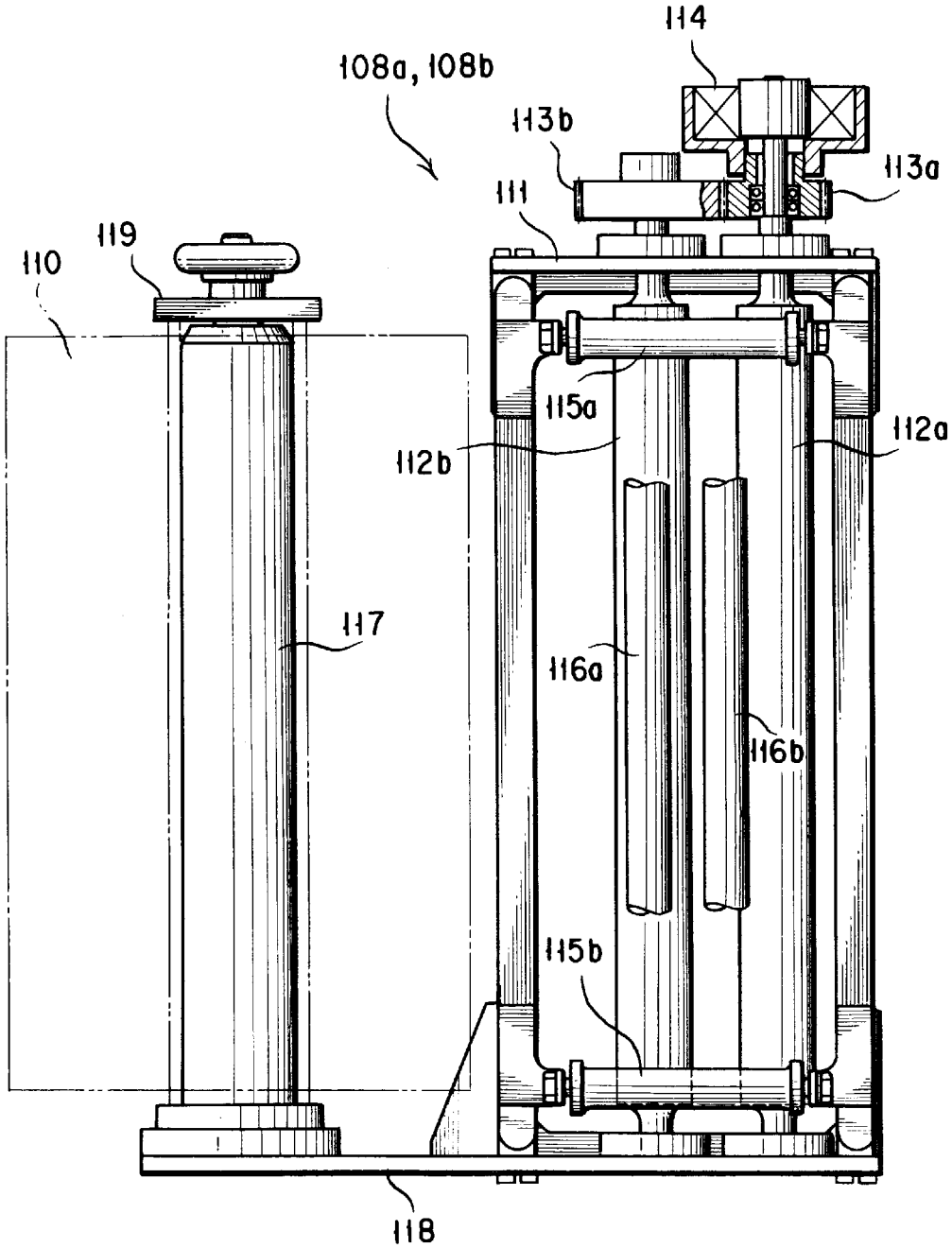
FIG. 20 is a top plan view illustrating a film feeder for use in a third form of implementation of the present invention.
Figure 21:
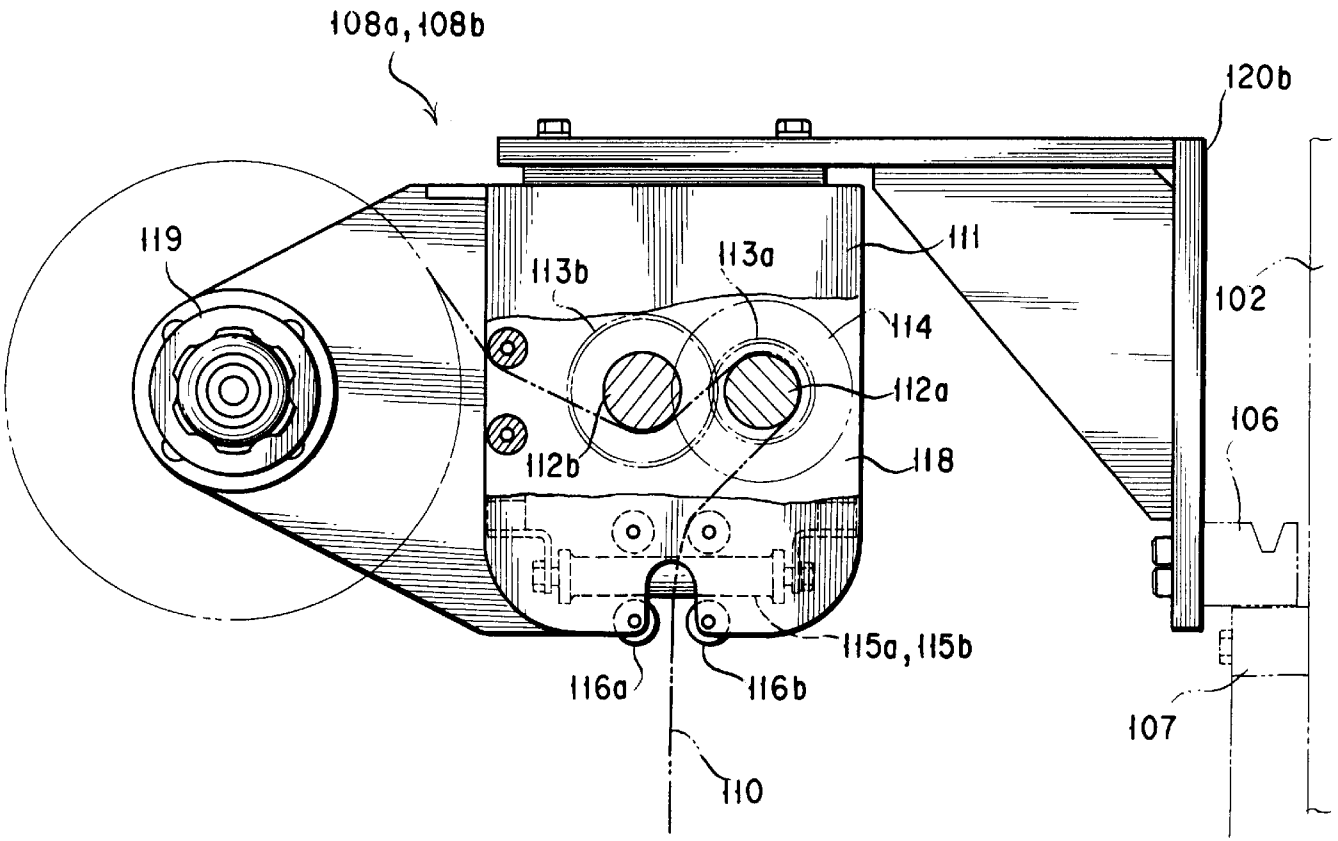
FIG. 21 is a side view illustrating the film feeder shown in FIG. 20.
Figure 22:
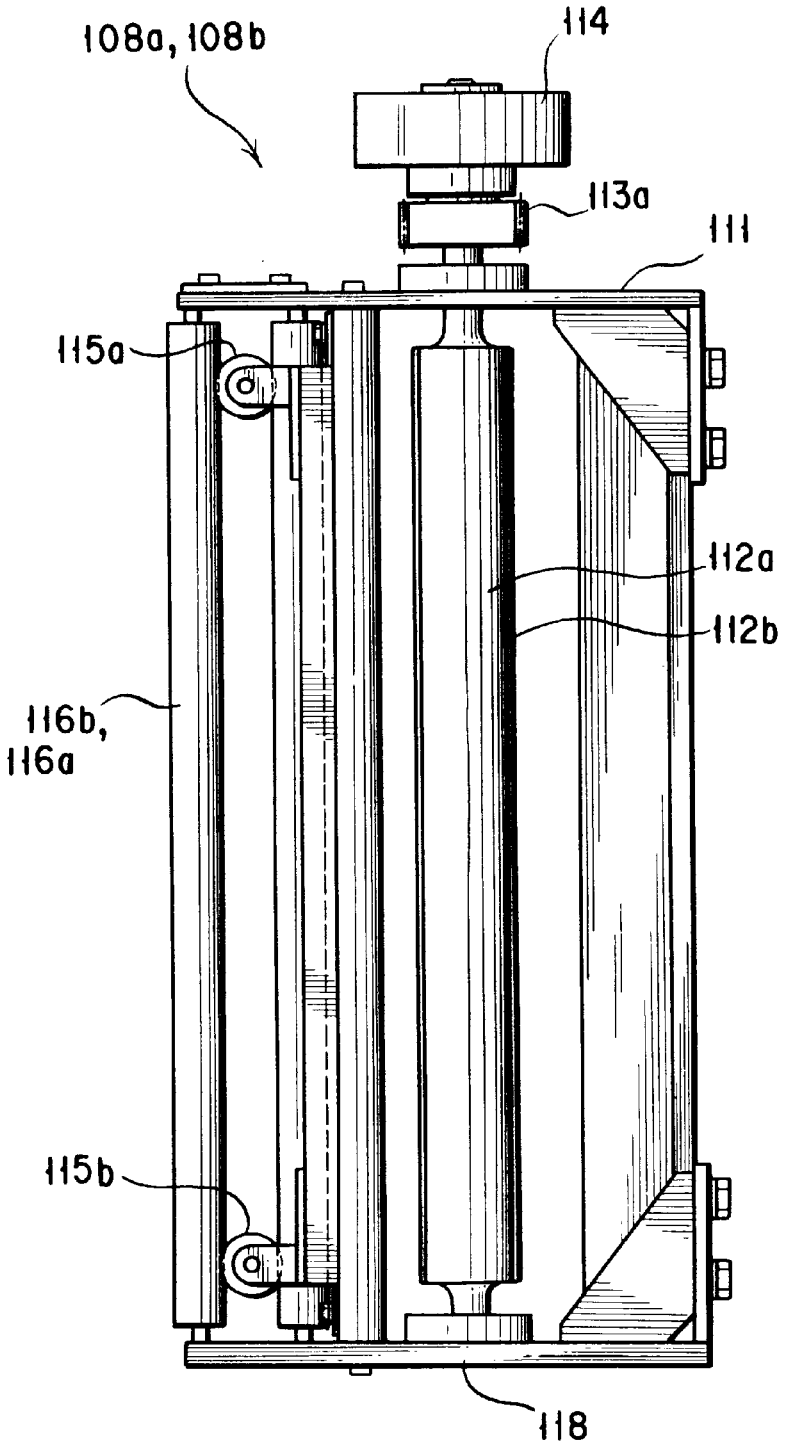
FIG. 22 is a front view illustrating the film feeder shown in FIGS. 20 and 21.

The film feeders 108*a,* 108*b* are constructed as shown in FIGS. 20 to 22. A U-shaped pedestal 111 has a first and a second roll 112*a* and 112*b* rotatably supported thereby and parallel to one another. The first and second rolls 112*a* and 112*b* have a first and a second toothed wheel or gear 113*a* and 113*b* attached respectively thereto, which mesh with each other. The first gear 113*a* is rotatably mounted to an end shaft of the first roll 112*a,* and the second gear 113*b* is fastened to an end shaft of the second roll 112*b*. The end shaft of the first roll 112*a* is coupled to the first gear 113*a* via a centrifugal clutch 114. The first and second gears 113*a* and 113*b* have such a gear ratio, for example, of 1:2, such that a rotation of the first gear 113*a* is transmitted, reduced in speed, to the second gear 113*b*.

The U-shaped pedestal 111 has its open side in which a pair of guide rolls 115*a* and 115*b* are disposed and oriented perpendicularly to the rolls 112*a* and 112*b*. Disposed ahead of the guide rolls 115*a* and 115*b* are a pair of outlet rolls 116*a* and 116*b*.

Juxtaposed with the second roll 112*b* of the pedestal 111 sideways thereof is a film support shaft 117 that carries a roll of film 110. Extending parallel to the rolls 112*a* and 112*b,* the film support shaft 117 has one end fastened to a bracket 118 that is in turn fastened to the pedestal 111, and its other end has a film pressure foot 119 detachably attached thereto.

As shown in FIG. 17, one of the first and second film feeders 108*a* and 108*b* so constructed as described above, here the first film feeder 108*a,* is attached to the rotary ring 106 by a first mounting bracket 120*a* so that its film support shaft 117 lies parallel to the axis of rotation of the rotary ring. And, the second film feeder 108*b* likewise is attached to the rotary ring 106 by a second mounting bracket 120*b* so that its film support 117 lies perpendicularly to the axis of rotation of the rotary ring 106.

Figure 23:
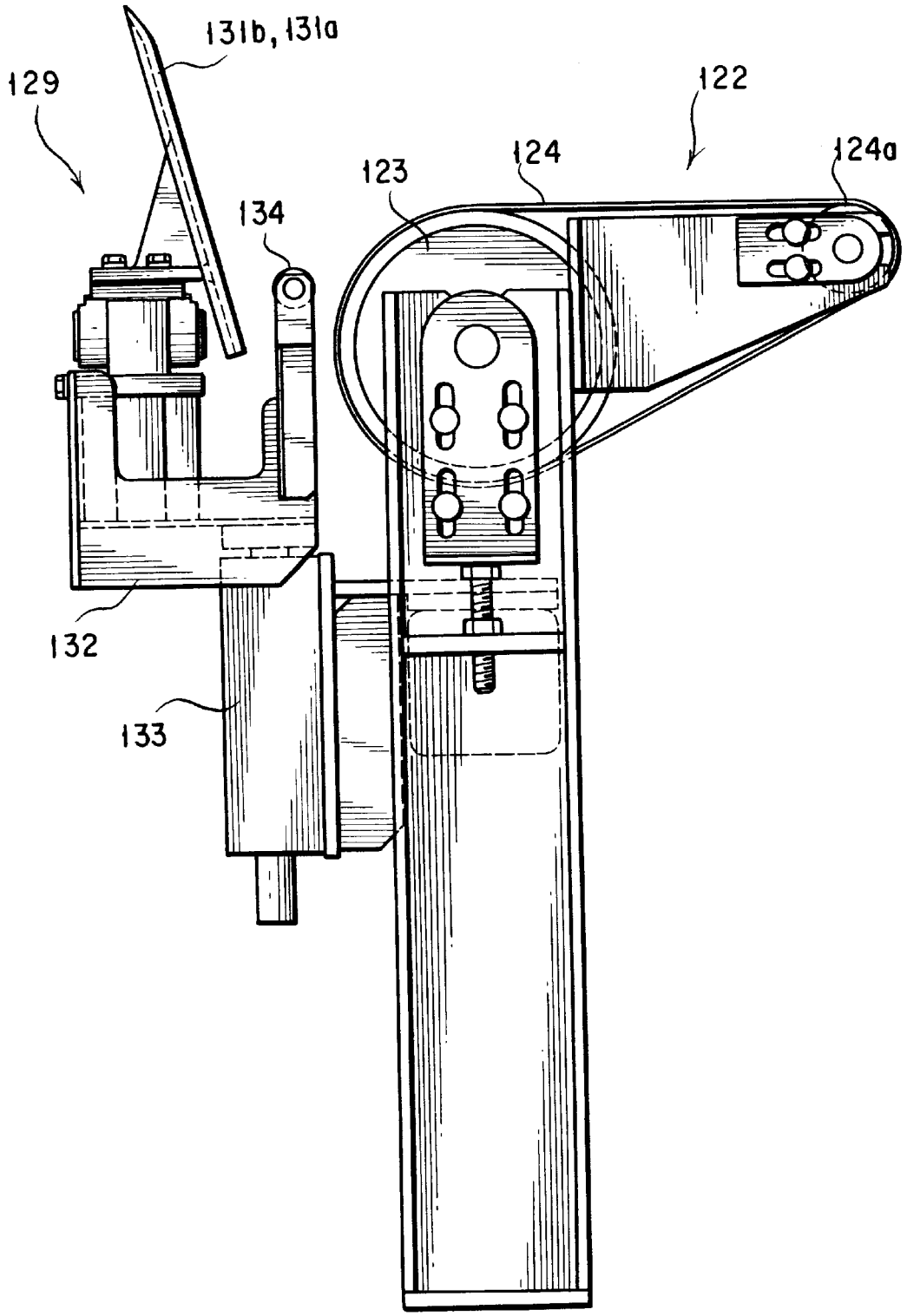
FIG. 23 is a side view illustrating a chucking assembly for use in the third form of implementation of the present invention.

Within an interior of the frame 102 at a rear end side thereof there is disposed a press nozzle 121 that is shaped to surround loadable object A. Further, a pair of guide plates 121*a* and 121*b* lie parallel to one another above and below the axis of rotation of the rotary ring 106, and face forwardly from an end portion of the press nozzle 121. A feed roll assembly 122 is also provided in an extension of a leading end of lower guide plate 121*b*. The feed roll assembly 122 as shown in FIG. 23 comprises a rotary roll 123 having a motor incorporated therein, a feed belt 124 wound over this rotary roll, and a roll 124*a* in a side of the guide plate 121*b*.

Disposed above the feed roll assembly 122 is a hold-down roll assembly 125 that comprises one or two press rolls 126 for holding down the loadable object A on the feed roll assembly 122. Each press roll 126 is rotatably supported by a bracket 127 that is movable up and down by a cylinder drive.

A loadable object feeder 128 is disposed rearwardly of the frame 2. For the loadable object feeder 128, use may be made of, e.g., a refuse compressor, which compresses refuse into a substantially rectangular parallelepiped compact refuse of a given size. Such a compact refuse as a loadable object A may be pushed out by a built-in cylinder drive into the press nozzle 121 included in the frame 102. The frame 102 and the loadable object feeder 128 are so arranged that when the frame 102 is moved rearwardly and is locked at a predetermined position, the rear end of the frame 102 is connected to a forward end of the loadable object feeder 128.

On a front side of the frame 102 and ahead of the feed roll assembly 122, there are provided a chucking assembly 129 for chucking film 110 and a cutter assembly 130 for cutting the chucked film at its downstream side (loadable object's side).

Figure 24:
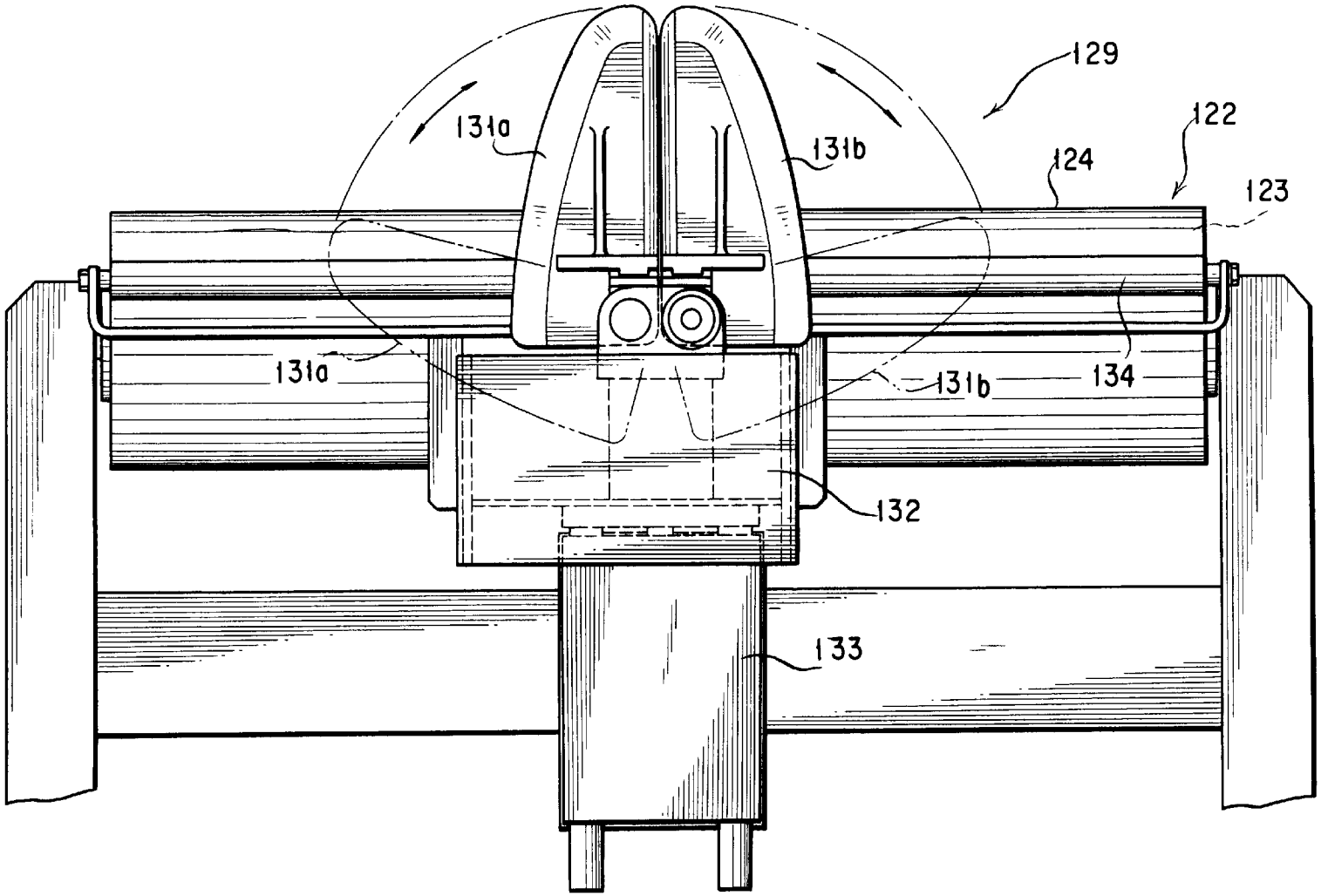
FIG. 24 is a front view illustrating the chucking assembly shown in FIG. 23.
Figure 25:
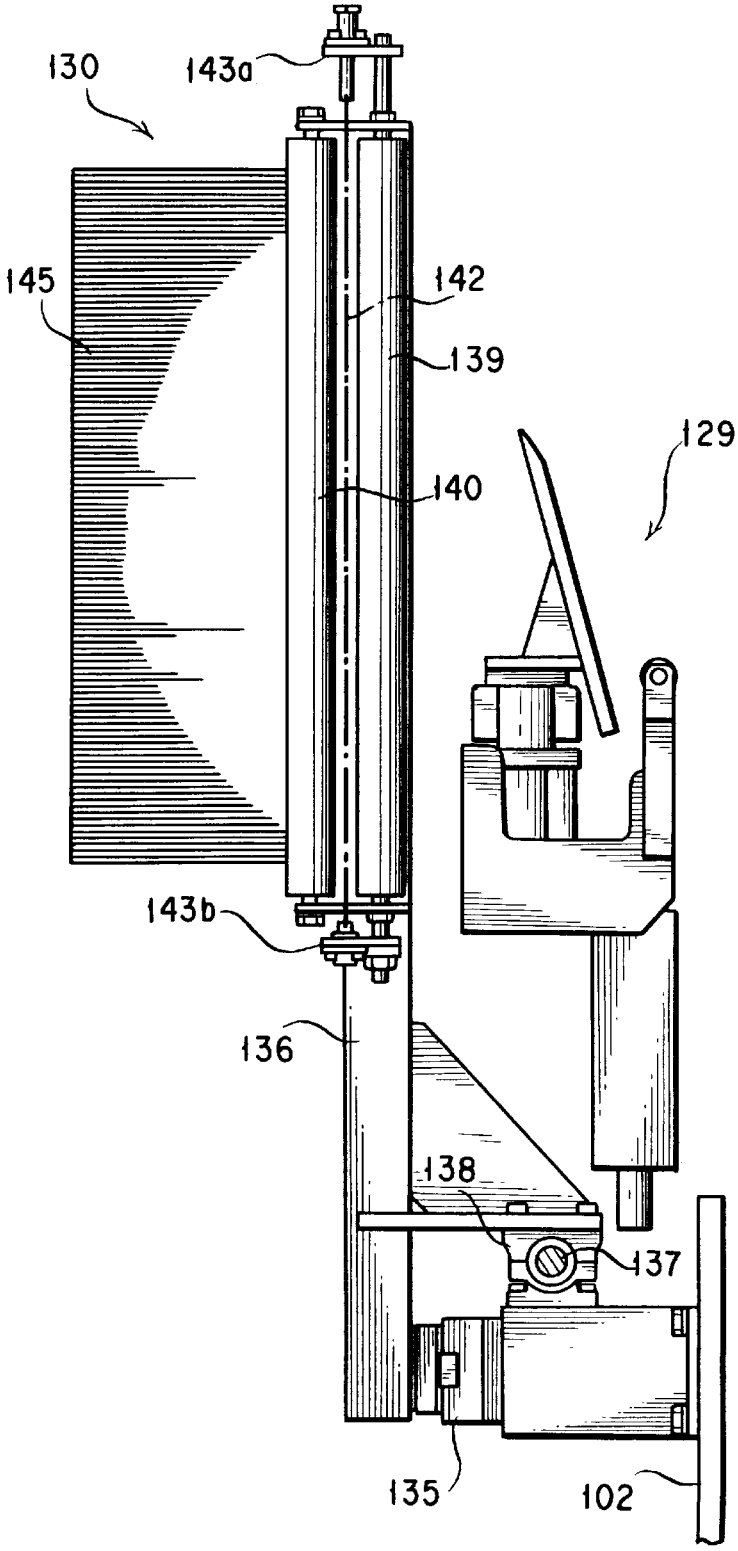
FIG. 25 is a side view illustrating a cutter assembly for use in the third form of implementation of the present invention.
Figure 26:
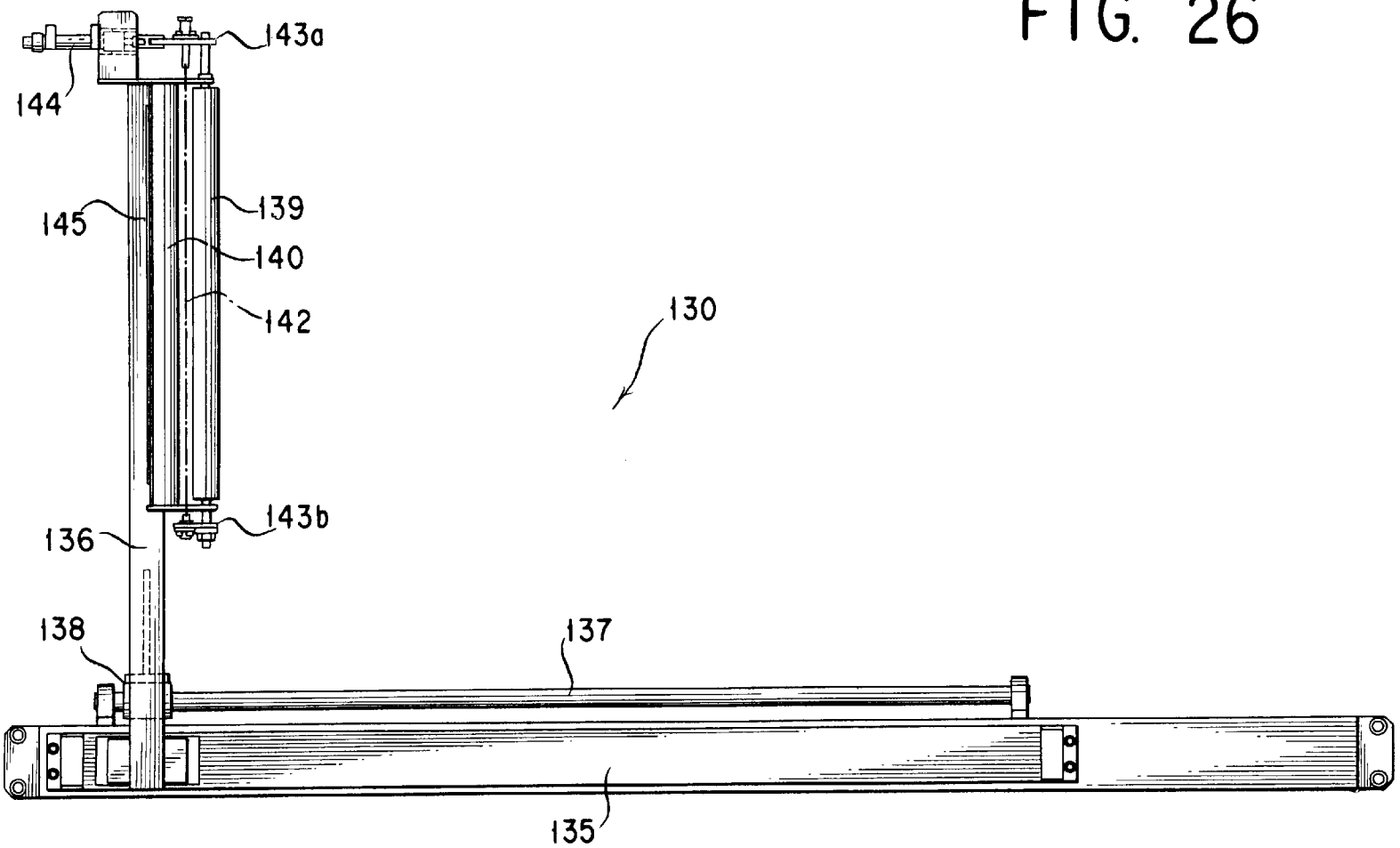
FIG. 26 is a front view illustrating the cutter assembly shown in FIG. 25.
Figure 27:
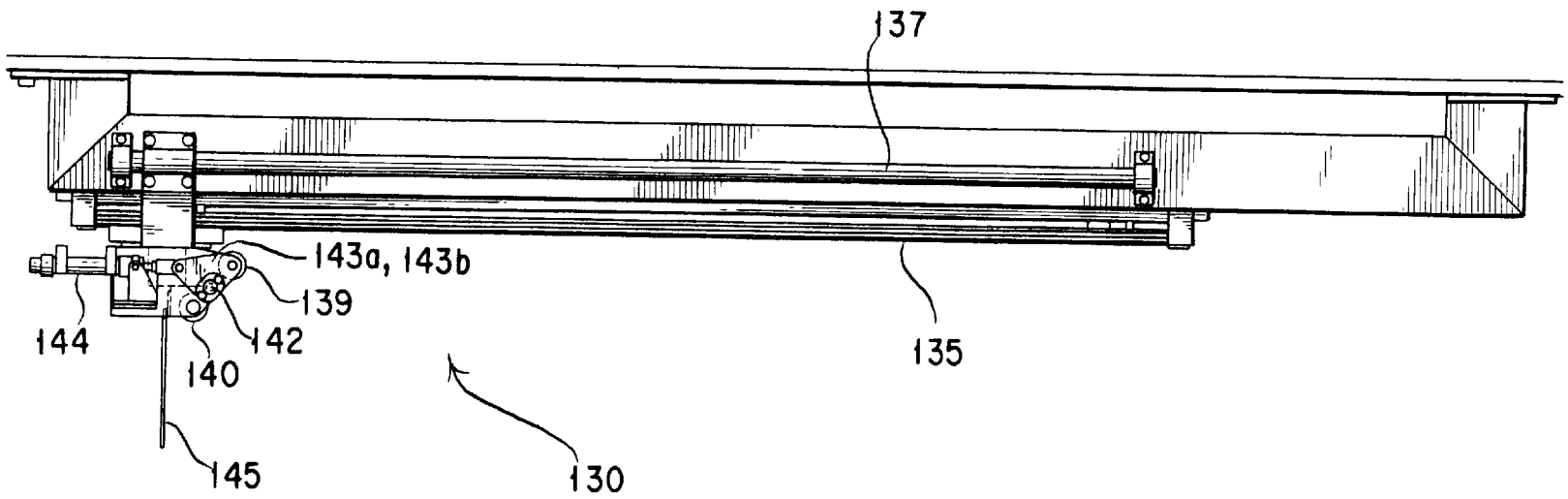
FIG. 27 is a top plan view illustrating the cutter assembly shown in FIGS. 25 and 26.
Figure 28:
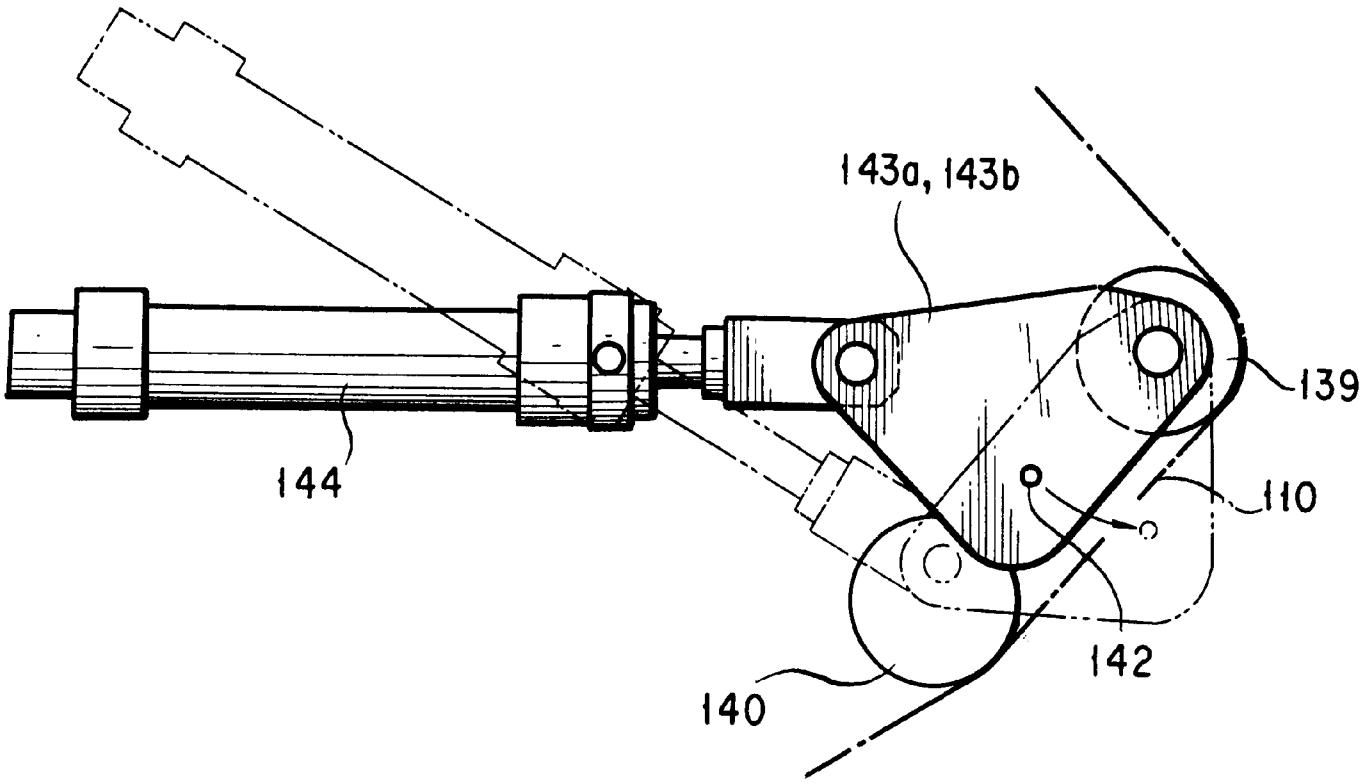
FIG. 28 is an explanatory view to aid in understanding the operation of the cutter assembly shown in FIGS. 25 to 27.

The chucking assembly 129 is constructed as shown in FIGS. 23 and 24 and includes a pair of chucking edges 131*a* and 131*b,* which are operable by a drive mechanism not shown to be opened upwardly by being pivotally swung left and right (as shown in FIG. 24), and closed by being brought together. These chucking edges 131*a* and 131*b* are carried on a base 132 that is lifted and lowered by a guide equipped cylinder drive 133. A free roll 134 is positioned behind the chucking edges 131*a* and 131*b* and rotatably supported by the base 132. The guide equipped cylinder drive 133 is supported by the frame that supports the feed roll assembly 122. When the base 132 is lumped and the chucking edges 131*a* and 131*b* are opened to a maximum, the chucking edges 131*a* and 131*b* are lower than a conveyor surface of the conveyor roll assembly 122 so as not to interfere with the loadable object A being carried thereby.

The cutter assembly 130 is constructed as shown in FIGS. 25 to 28. A rodless cylinder 135 is horizontally fastened to a lower part of the front side of the frame 102. A cutter arm 136 that stands upright has a lower end portion horizontally movable, which is engaged with the rodless cylinder 135. Further, above the rodless cylinder 135, a guide rod 137 extends orthogonal to the guide rails 104*a* and 104*b,* and a linear bush 138 attached to the cutter arm 136 is fitted with the guide rod 137. These elements are thus arranged so that operating the rodless cylinder 135 causes the cutter arm 136 to move forth and back horizontally along the rodless cylinder and the guide rod 137.

The cutter arm 136 has a guide roll 139 longitudinally supported thereby to be rotatable. Also, ahead of the guide roll 139, a second guide roll 140 extends parallel thereto. And, between the guide rolls 139 and 140, a heater wire 142 extending parallel thereto is disposed so that it may rise above and sink below a line that links peripheral guide surfaces of the guide rolls 139 and 140. The heater wire 142 is taut between a pair of rotary members, upper member 143*a* and lower member 143*b,* rotatably mounted to the cutter arm 136 by a cylinder drive 144. The cutter arm 136 has on a front thereof a brush 145.

In front of the ring-rotated wrapping machine 101 there lies a frame 146 along the floor, which is provided at its forward end with a pair of rollers 103*a* adapted to roll over the floor. The frame 146 has a lift equipped rotary table 147.

The lift equipped rotary table 147 comprises a lifting assembly provided in the frame 146 but not shown, and a rotary table 148 loaded on a liftable table 147*a* for being lifted and lowered by such a lifting assembly.

For the lifting assembly not shown, use may be made of a pantograph type. The rotary table 148 is made rotatable bi-directionally about a vertical axis by a rotary drive included in the liftable table 147*a* but not shown.

On the rotary table 148 a conveyor 150 is provided. The conveyor 150 includes a conveyor belt 149 and is movably guided by guide plates 148*a* and 148*b* in a direction in which the conveyor belt 149 travels. The conveyor belt 149 is driven to travel by a belt driving mechanism (not shown) included in the conveyor 150, and the conveyor 150 is driven to move by a movement drive mechanism (not shown) included in the rotary table 148.

The liftable table 147*a* includes a stabilizer 151 designed to hold down an upper surface of a loadable object A placed on the conveyor belt 149 of the rotary table 148, and thereby to stabilize the loadable object A so placed. The stabilizer 151 comprises a support post 152 that stands upright on a corner of the liftable table 147*a,* an extension arm 153 extendible from the support post 152, and a keep plate 154 facing downwardly from a horizontal extension of the vertical extension arm 153. The extension arm 153 is adapted to be extended by a suitable extending mechanism such as a cylinder drive included in the support post 152 but not shown.

Mention is next made of an operation of the apparatus constructed as described above. Prior to initiating a wrapping operation for a loadable object A, chucking is effected, by the chucking edges 131*a* and 131*b* of the chucking assembly 129, of ends of continuous strips of film 110 and 110 paid out, respectively, from the first and second film feeders 108*a* and 108*b*.

Also, the lift equipped rotary table assembly 147 is lifted until an upper surface of the conveyor 150 becomes flush with a conveyor surface of the conveyor roll assembly 122, and the rotary table 148 is rotated to orient the conveyor 150 so that it may move in a predetermined forward and backward direction. Further, the conveyor 150 is moved rearwardly, namely to a position adjacent to the conveyor roll assembly 122, and the conveyor belt 149 is made to travel reawardly.

In this state, a compact formed as the loadable object A by compression in the loadable object feeder 128 is pushed out from the latter by an extruder therein to enter through the press nozzle 121, of the ring-rotated wrapping machine 101, into a region defined by the upper and lower guide plates 121*a* and 121*b*. Then, as the loadable object A is received first by the press nozzle 121 and then by the lower guide plate 121*b,* any dropout from the loadable object A as accepted by the press nozzle 121 is prevented from scattering or flying into surrounding areas.

When the loadable object A is pushed to project into the interior of the ring-rotated wrapping machine 101 by a predetermined length thereof, the rotary ring 106 is allowed to start rotating. Rotating the rotary ring 106 causes film 110 and film 110 paid out from and pulled out of the first and second film feeders 108*a* and 108*b,* respectively, to be wound spirally, from an outside of an end portion of the press nozzle 121 and the upper and lower guide plates 121*a* and 121*b,* around the loadable object A about a horizontal axis at a pitch according to a speed of travel of the loadable object A.

Figure 29:
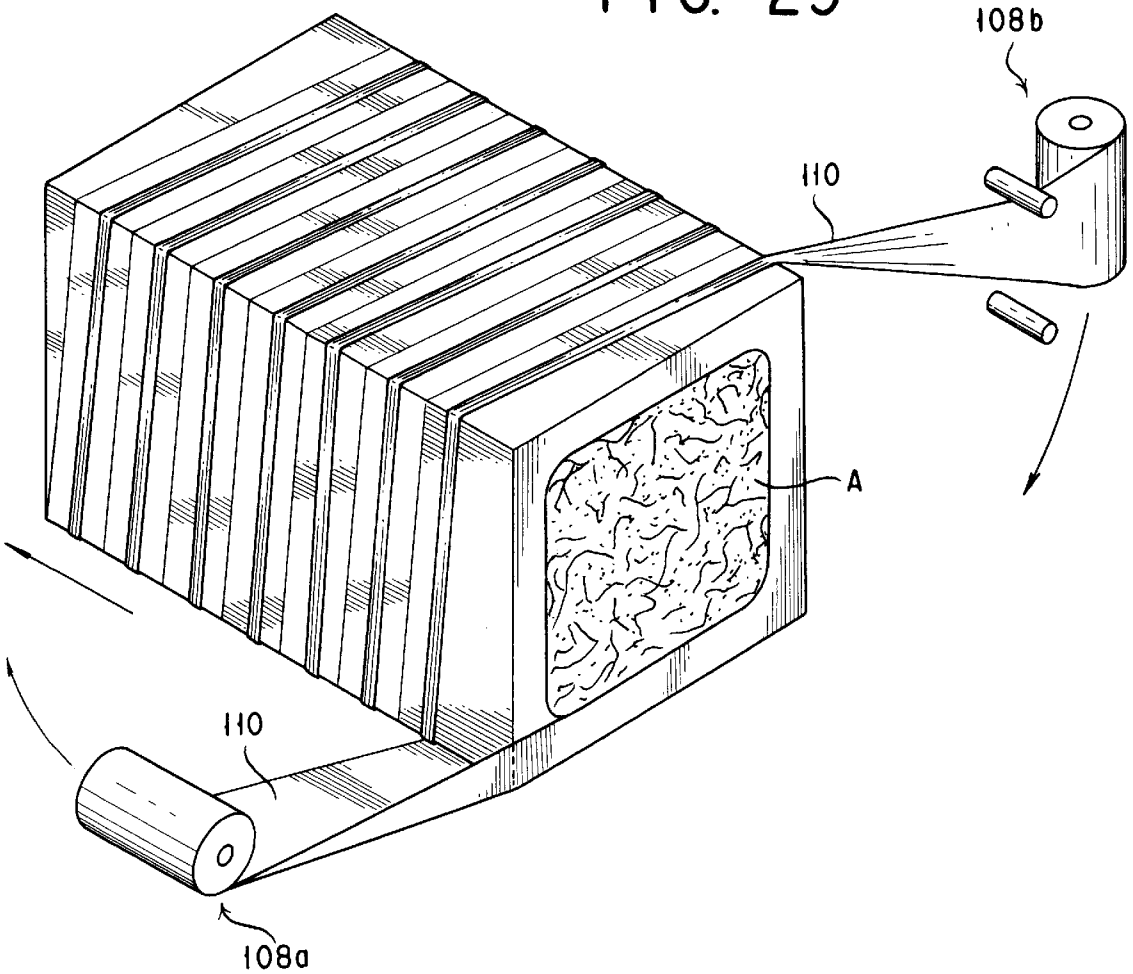
FIG. 29 is a perspective view illustrating a film wrapped loadable object.

Then, as shown in FIG. 29, film 110 paid out from the first film feeder 108*a,* in which the film support shaft 117 that carries a roll of film 110 is oriented parallel to the axis rotation of the rotary ring 106, is wound in the form of a continuous strip of film around the loadable object A, while film 110 paid out from film feeder 108*b,* in which the film support shaft 117 that carries a roll of film 110 is oriented at a right angle to the axis rotation of the rotary ring 106, is wound, compressed in a direction of its width, in the form of a continuous string of film around the loadable object A. Thus, a continuous strip of film 110 and continuous string of film 110 are alternately spirally wound on the loadable object A.

With each of the film feeders 108*a* and 108*b,* feeding film 110 by pulling causes the first and second rolls 112*a* and 112*b* to be rotationally driven. When a speed of driven rotation of the first roll 112*a* is raised to a certain extent following a rise in a rate of winding or a force of pulling the film 110, the centrifugal clutch 114 becomes operable to couple the first roll 112*a* with the first gear 113*a*. This causes the second roll 112*b* to be rotationally driven by the first roll 112*a* via the first and second gears 113*a* and 113*b* meshing with each other. Then, with the gear ratio of the two gears 113*a* and 113*b* being 1:2, the second roll 112*b* is rotated at a speed one half the speed at which the first roll 112*a* is rotated. As a result, the film that passes over the rolls 112*a* and 112*b* slides on the second roll 112*a* and stretches between the rolls 112*a* and 112*b*. In this case, a degree of stretch or elongation of film 110 is proportional to a rate of paying out of film 110, and reaches the gear ratio of 1:2 at maximum.

As described above, in the ring-rotated wrapping machine 101 the loadable object A together with the forward end of the press nozzle 121 and the upper and lower guide plates 121*a* and 121*b* have, as the loadable object is moved, film 110 wound therearound about a horizontal axis of the loadable object. Then, film 110 slides on the press nozzle 121 and the upper and lower guide plates 121*a* and 121*b,* and moves with the loadable object A. The loadable object A, by being between the press nozzle 121 and the upper and lower guide plates 121*a* and 121*b* while it is being wound with film 110, prevents any dropout thereof from scattering or flying into surrounding areas.

The loadable object A, in the ring-rotated wrapping machine 101, prior to leaving the loadable object feeder 128 is passed over to the conveyor roll assembly 122 and is thereby allowed to move further ahead. Then, downward movement of the hold-down roll assembly 125 with the hold-down roll 126 pressing the loadable object A downwardly against the conveyor roll assembly 122 allows the loadable object A to continue to move at a given speed without sliding.

When the loadable object A begins to be wound with film 110, the chucking assembly 129 lowers the base 132 and has the two chucking edges 121*a* and 121*b* opened to their maximum extent so as not to interfere with the loadable object A carried by the conveyer roller 122.

In this manner, the loadable object A pushed out through the press nozzle 121 and between the upper lower guide plates 121*a* and 121*b,* having a continuous strip of film 110 and a continuous string of film 110 alternately wound longitudinally around it inclusive with the press nozzle 121 and the guide plates 121*a* and 121*b* as the loadable object A moves, is transported to the lift equipped rotary table 147. Then, when a rear end of the loadable object A reaches, say, near ends of the guide plates 121*a* and 121*b,* the rotary ring 106 ceases to be rotated to stop film 110 from being wound; thus ending a process of winding film 110 about a horizontal axis.

When the loadable object A is passed onto the conveyor 150 of the rotary table 148, the conveyor 150 is moved to a center region of the rotary table 148 and the stabilizer 151 is actuated to hold down the upper surface of the loadable object A with the keep plate 154.

This is followed by lifting the liftable table 147*a* with the lifting assembly while rotating the rotary table 148, indicated by the arrow in FIG. 17. This permits film 110 and 110 to be pulled out from the film feeders 108*a* and 108*b,* and to be wound and thereby wrapped around the loadable object A about a vertical axis. Then, since a change occurs in the axis about which the films 110 and 110 are wound around the loadable object A from horizontal to vertical, the film 110 is fed out in the form of a continuous string from the film feeder 108*a,* and the film 110 is fed out in the form of a continuous strip from the film feeder 108*b,* with the films 110 and 110 being wound alternately.

After a process of laterally winding film 110 has ended, the rotary table 148 comes to stop, the liftable table 147*a* lowers, and the stabilizer 151 ceases to pressure hold the loadable object A. The conveyor 150 is moved back to resume its position near the conveyer roll assembly 122 to bring the wrapped loadable object A in close proximity of the cutting assembly 130. Thereafter, the cutter arm 136 of the cutting assembly 130 is moved to a center region of the ring-rotated wrapping machine 101 where the above-mentioned two films 110 and 110 are brought together by the guide roll 139. Then, these two films, extending respectively from the two film feeders 108*a* and 108*b* to the loadable object A on the lift equipped rotary table 147, are chucked when the chucking edges 131*a* and 131*b* come close together during rising of the chucking assembly 129.

What follows next is cutting (fusing) the films 110 by projecting the heater wire 142 of the cutting assembly 130. Then, with the cutter arm 136 moving in the same direction, cut ends of the films 110 near the loadable object A are adhered to the film wrapped loadable object A by the brush 145 smoothing down those cut ends onto surfaces of the loadable object.

As a result of the foregoing operations, the loadable object A supplied from the loadable object feeder 128 now has both a continuous strip and a continuous string of film 110 and 110 wound around it both lengthwise and crosswise, and is thereby fully wrapped.

For performing a maintenance operation for the ring-rotated wrapping machine 101 and the loadable object feeder 128, the ring-rotated wrapping machine 101 is moved forward to create a space between the ring-rotated wrapping machine and the loadable object feeder in which an operation may be conducted.

Apart from the forms of implementations of this invention described in the foregoing, the present invention does not exclude a possibility of using the first and second film feeders 108*a* and 108*b,* and feeding a loadable object A solely in a direction of a horizontal axis so as to permit a continuous strip and a continuous string of film 110 and 110 to be alternately wound spirally around the loadable object A about the horizontal axis, so as to cover its essential four surfaces alone therewith.

Further, both a continuous strip and a continuous string of film may be fed from a single film feeder.

As set forth in the foregoing, the present invention permits a loadable object supplied from a loadable object feeder to be received by a press nozzle and then wound with film in a wrapping machine, thereby preventing any dropout of the supplied loadable object from scattering or flying in the wrapping machine. Also, the capability of winding both a continuous strip of film and a continuous string of film, compressed from such a strip of film, spirally around a loadable object makes wrapping much less rupturable.

Further, revolving two film feeders about a horizontal axis allows a continuous strip of film and a continuous string of film to be paid out from one and the other film feeders, respectively, for winding a loadable object about a horizontal axis. Further, passing the loadable object onto a rotary table and rotating the rotary table about a vertical axis allows another continuous strip of film and another continuous string of film to be wound around the loadable object about a vertical axis. Then, lifting the rotary table permits winding such strip and string of film spirally about the vertical axis.

Further, film being fed from a film feeder is stretched while it passes between a pair of rolls associated with the film feeder. The degree of such stretching or elongation can be increased proportionally to a film winding rate or pulling force.

There is also provided an arrangement that facilitates placement of a loadable object from its film wrapping position onto the rotary table. Another arrangement facilitates supplying a loadable object from a separate feeder while preventing any dropout of the supplied loadable object from scattering or flying into surrounding areas.

Yet further, structure that makes the ring-rotated wrapping machine movable relative to the loadable object feeder facilitates maintenance of both of these mechanisms, and makes it easy to clean corresponding areas of the apparatus.

Although the present invention has been described in terms of the presently preferred implementations as applied to a method of and an apparatus for wrapping a loadable object, it is to be understood that such disclosure is purely illustrative and is not to be interpreted as limiting. Consequently, without departing from the spirit and scope of the invention, various alterations, modifications, and/or alternative applications of the invention will, no doubt, be suggested to those skilled in the art after having read the preceding disclosure. Accordingly, it is intended that the following claims be interpreted as encompassing all alterations, modifications, or alternative applications as fall within the true spirit and scope of the invention.

What is claimed is:

1. A method of wrapping an object, comprising:

placing an object on and between sleeve pallets that are adapted to accept a fork of a forklift;

alternately spirally winding a continuous strip of film and a continuous string of film around said object with said sleeve pallets inclusive such that said continuous strip of film and said continuous string of film are overlapped with one another along a length of said object; and then spirally winding film around said object with said sleeve pallets inclusive in a direction that is generally orthogonal to a direction in which said continuous strip of film and said continuous string of film were spirally wound around said object with said sleeve pallets inclusive, wherein alternately spirally winding a continuous strip of film and a continuous string of film around said object with said sleeve pallets inclusive comprises alternately spirally winding, in the same direction, said continuous strip of film and said continuous string of film around said object with said sleeve pallets inclusive such that on said object and said sleeve pallets turns of said continuous strip of film are parallel to turns of said continuous string of film.

2. A method of wrapping an object, comprising:

extruding an object through a press nozzle into an area defined between a pair of guide plates;

alternately spirally winding a continuous strip of film and a continuous string of film around said object with a portion of said press nozzle and said guide plates inclusive such that said continuous strip of film and said continuous string of film are overlapped with one another along a length of said object; and then spirally winding film around said object in a direction that is generally orthogonal to a direction in which said continuous strip of film and continuous string of film were spirally wound around said object, wherein alternately spirally winding a continuous strip of film and a continuous string of film around said object comprises alternately spirally winding, in the same direction, said continuous strip of film and said continuous string of film around said object such that on said object turns of said continuous strip of film are parallel to turns of said continuous strip of film.

3. A method of wrapping an object, comprising:

extruding an object through a press nozzle into an area defined between a pair of guide plates;

alternately spirally winding a continuous strip of film and a continuous string of film around said object with a portion of said press nozzle and said guide plates inclusive such that said continuous strip of film and said continuous string of film are overlapped with one another along a length of said object; and then spirally winding film around said object in a direction that is generally orthogonal to a direction in which said continuous strip of film and continuous string of film were spirally wound around said object, wherein alternately spirally winding a continuous strip of film and a continuous string of film around said object such that said continuous strip of film and said continuous string of film are overlapped with one another along a length of said object comprises alternately spirally winding said continuous strip of film and said continuous string of film around said object such that said continuous string of film is positioned on said continuous strip of film along the length of said object.

4. A method of wrapping an object, comprising:

extruding an object through a press nozzle into an area defined between a pair of guide plates;

alternately spirally winding a continuous strip of film and a continuous string of film around said object with a portion of said press nozzle and said guide plates inclusive such that said continuous strip of film and said continuous string of film are overlapped with one another along a length of said object; and then spirally winding film around said object in a direction that is generally orthogonal to a direction in which said continuous strip of film and continuous string of film were spirally wound around said object, wherein alternately spirally winding a continuous strip of film and a continuous string of film around said object comprises simultaneously spirally winding said continuous strip of film and said continuous string of film around said object.

5. A method of wrapping an object, comprising:

extruding an object through a press nozzle into an area defined between a pair of guide plates;

alternately spirally winding a continuous strip of film and a continuous string of film around said object with a portion of said press nozzle and said guide plates inclusive such that said continuous strip of film and said continuous string of film are overlapped with one another along a length of said object; and then spirally winding film around said object in a direction that is generally orthogonal to a direction in which said continuous strip of film and continuous string of film were spirally wound around said object, wherein alternately spirally winding a continuous strip of film and a continuous string of film around said object, with a portion of said press nozzle and said guide plates inclusive, comprises revolving a film feeder about a first axis along a circular path while (i) supplying said continuous strip of film and said continuous string of film from said feeder, and (ii) advancing said object through said circular path and along said first axis.

6. The method according to claim 5, wherein spirally winding film around said object in a direction that is generally orthogonal to a direction in which said continuous strip of film and said continuous string of film were spirally wound around said object, with a portion of said press nozzle and said guide plates inclusive, comprises (i) ceasing said film feeder from being revolved, and (ii) advancing said object along a second axis that is orthogonal to said first axis while (a) rotating said object about said second axis, and (b) supplying said film to said object.

7. The method according to claim 6, wherein supplying said continuous string of film from said film feeder comprises supplying from said film feeder a continuous string of film that is formed by compressing a continuous strip of film.

8. A method of wrapping an object, comprising:

extruding an object through a press nozzle into an area defined between a pair of guide plates; and alternately spirally winding a continuous strip of film and a continuous string of film around said object with a portion of said press nozzle and said guide plates inclusive such that said continuous strip of film and said continuous string of film are overlapped with one another along a length of said object, wherein extruding an object through a press nozzle comprises conveying an object from an object feeder through said press nozzle, and wherein alternately spirally winding a continuous strip of film and a continuous string of film around said object, with a portion of said press nozzle and said guide plates inclusive, comprises revolving a film feeder about an axis along a circular path while (i) supplying said continuous strip of film and said continuous string of film from said film feeder, and (ii) advancing said object through said circular path along said axis.

9. The method according to claim 8, wherein supplying said continuous string of film from said film feeder comprises supplying from said film feeder a continuous string of film that is formed by compressing a continuous strip of film.

10. The method according to claim 8, wherein alternately spirally winding a continuous strip of film and a continuous string of film around said object comprises alternately spiral winding, in the same direction, said continuous strip of film and said continuous string of film around said object such that on said object turns of said continuous strip of film are parallel to turns of said continuous string of film.

11. The method according to claim 8, wherein alternately spirally winding a continuous strip of film and a continuous string of film around said object such that said strip of film and said string of film are overlapped one another along a length of said object comprises alternately spirally winding a continuous strip of film and a continuous string of film around said object such that said string of film is positioned on said strip of film along the length of said object.

12. The method according to claim 8, wherein alternately spirally winding a continuous strip of film and a continuous string of film around said object comprises simultaneously spirally winding said continuous strip of film and said continuous string of film around said object.

13. The method according to claim 8, further comprising, after alternately spirally winding said continuous strip of film and said continuous string of film around said object, with a portion of said press nozzle and said guide plates inclusive, spirally winding film around said object in a direction that is generally orthogonal to a direction in which said continuous strip of film and continuous string of film were spirally wound around said object.

14. A method of wrapping an object, comprising:

placing an object on and between sleeve pallets that are adapted to accept a fork of a forklift; and alternately spirally winding a continuous strip of film and a continuous string of film around said object with said sleeve pallets inclusive such that said continuous strip of film and said continuous string of film are overlapped with one another along a length of said object, wherein alternately spirally winding a continuous strip of film and a continuous string of film around said object with said sleeve pallets inclusive comprises simultaneously spirally winding said continuous strip of film and said continuous string of film around said object with said sleeve pallets inclusive.

15. The method according to claim 14, wherein simultaneously spirally winding said continuous strip of film and said continuous string of film around said object with said sleeve pallets inclusive comprises simultaneously spirally winding, in the same direction, said continuous strip of film and said continuous string of film around said object with said sleeve pallets inclusive such that on said object and said sleeve pallets turns of said continuous strip of film are parallel to turns of said continuous string of film.

16. The method according to claim 14, wherein simultaneously spirally winding said continuous strip of film and said continuous string of film around said object with said sleeve pallets inclusive such that said continuous strip of film and said continuous string of film are overlapped with one another along a length of said object comprises simultaneously spirally winding said continuous strip of film and said continuous string of film around said object with said sleeve pallets inclusive such that said continuous string of film is positioned on said continuous strip of film along the length of said object.

17. The method according to claim 14, wherein simultaneously spirally winding said continuous strip of film and said continuous string of film around said object with said sleeve pallets inclusive comprises revolving a film feeder about an axis along a circular path while (i) supplying said continuous strip of film and said continuous string of film from said feeder, and (ii) advancing said object and said sleeve pallets through said circular path and along said axis.

18. The method according to claim 17, wherein supplying said continuous string of film from said film feeder comprises supplying from said film feeder a continuous string of film that is formed by compressing a continuous strip of film.

19. The method according to claim 14, further comprising, after simultaneously spirally winding said continuous strip of film and said continuous string of film around said object with said sleeve pallets inclusive, spirally winding film around said object with said sleeve pallets inclusive in a direction that is generally orthogonal to a direction in which said continuous strip of film and said continuous string of film were spirally wound around said object with said sleeve pallets inclusive.

20. The method according to claim 19, wherein simultaneously spirally winding a continuous strip of film and a continuous string of film around said object with said sleeve pallets inclusive comprises revolving a film feeder about a first axis along a circular path while (i) supplying said continuous strip of film and said continuous string of film from said feeder, and (ii) advancing said object and said sleeve pallets through said circular path and along said first axis.

21. The method according to claim 20, wherein spirally winding film around said object with said sleeve pallets inclusive in a direction that is generally orthogonal to a direction in which said continuous strip of film and said continuous string of film were spirally wound around said object with said sleeve pallets inclusive comprises (i) ceasing said film feeder from being revolved, and (ii) advancing said object and said sleeve pallets along a second axis that is orthogonal to said first axis while (a) rotating said object and said sleeve pallets about said second axis, and (b) supplying said film to said object and said sleeve pallets.

22. The method according to claim 21, wherein supplying said continuous string of film from said film feeder comprises supplying from said film feeder a continuous string of film that is formed by compressing a continuous strip of film.

* * * * *